US012378883B2

(12) United States Patent
Perry et al.

(10) Patent No.: US 12,378,883 B2
(45) Date of Patent: Aug. 5, 2025

(54) GUIDE SHOE FOR MINING MACHINE

(71) Applicant: Joy Global Underground Mining LLC, Warrendale, PA (US)

(72) Inventors: Ryan E. Perry, Venus, PA (US); Shawn Franklin, Emlenton, PA (US); Joshua Lutz, Mercer, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 125 days.

(21) Appl. No.: 18/097,067

(22) Filed: Jan. 13, 2023

(65) Prior Publication Data

US 2024/0240559 A1 Jul. 18, 2024

(51) Int. Cl.
*E21C 35/12* (2006.01)
*E21C 29/02* (2006.01)

(52) U.S. Cl.
CPC ..... *E21C 35/12* (2013.01); *E21C 29/02* (2013.01)

(58) Field of Classification Search
CPC ..... E21C 35/12; E21C 29/02
See application file for complete search history.

(56) References Cited

U.S. PATENT DOCUMENTS

| | | | | |
|---|---|---|---|---|
| 3,399,578 | A | 9/1968 | Lindabury, Sr. et al. | |
| 4,155,599 | A | 5/1979 | Groger et al. | |
| 4,155,600 | A | 5/1979 | Lanfermann et al. | |
| 4,307,915 | A | 12/1981 | Knorr | |
| 4,515,409 | A | 5/1985 | Parrott | |
| 4,644,873 | A | 2/1987 | Uttscheid | |
| 4,813,748 | A * | 3/1989 | Waddington | E21C 29/02 105/29.1 |
| 4,844,548 | A * | 7/1989 | Masovich | E21C 29/02 105/29.1 |
| 5,131,723 | A * | 7/1992 | Roling | F16G 13/14 59/85 |
| 5,704,267 | A | 1/1998 | Merten et al. | |
| 6,179,386 | B1 | 1/2001 | Meya et al. | |
| 6,267,449 | B1 | 7/2001 | Meya et al. | |
| 8,276,991 | B2 | 10/2012 | Thomson | |
| 9,273,552 | B2 | 3/2016 | Pietrala | |
| 9,617,852 | B2 | 4/2017 | Myers et al. | |
| 10,358,833 | B2 | 7/2019 | Dingler | |
| 10,731,461 | B2 | 8/2020 | Perry | |
| 2010/0019563 | A1 * | 1/2010 | Thomson | E21C 29/02 299/43 |
| 2021/0309283 | A1 | 10/2021 | Ishii | |

* cited by examiner

*Primary Examiner* — Janine M Kreck
(74) *Attorney, Agent, or Firm* — Husch Blackwell LLP

(57) ABSTRACT

An interface between a guide shoe of a mining machine and a rack includes a first surface positioned on the guide shoe. and a second surface positioned on the rack. At least one of the first surface and the second surface including a profile oriented at an oblique angle relative to a plane of the rack.

21 Claims, 22 Drawing Sheets

GUIDE SHOE FOR MINING MACHINE

BACKGROUND

The present disclosure relates to the field of mining machines and particularly to a trapping shoe for a longwall shearer mining machine.

Conventional longwall shearers include a frame and a pair of cutting assemblies mounted on each end of the frame. Each cutting assembly includes a cutting drum for engaging a mine wall. As the frame traverses a mine frame, the cutting drums cut material from the mine face. In some embodiments, the material is deposited on a conveyor and carried away from the mine face. The shearer includes a trapping shoe and sprocket that engage a rack to guide the machine with respect to the mine wall. During operation, the trapping shoe wears down, resulting in poor engagement between the sprocket and the rack and reducing machine control.

SUMMARY

In one independent aspect, a drive mechanism for a mining machine is configured to engage and move the mining machine along a rack. The drive mechanism includes a gear configured to engage the rack, rotation of the gear causing movement of the mining machine along the rack; and a guide shoe for maintaining engagement between the gear and the rack, the guide shoe including a wall having a surface configured to engage a surface of the rack. At least one of the surface of the wall and the surface of the rack is angled or curved.

In another independent aspect, a drive mechanism for a mining machine is configured to engage and move the mining machine along a rack. The drive mechanism includes a gear configured to engage the rack such that rotation of the gear moves the mining machine along the rack; and a guide shoe for maintaining engagement between the gear and the rack, the guide shoe including a wall having an angled surface. The rack includes a planar surface configured to engage the angled surface.

In yet another independent aspect, a drive mechanism for a mining machine is configured to engage and move the mining machine along a rack. The drive mechanism includes a gear configured to engage the rack such that rotation of the gear moves the mining machine along the rack, and a guide shoe for maintaining engagement between the gear and the rack. The guide shoe includes a first wall, and a hook extending from the first wall, wherein the hook includes a surface oriented substantially parallel to the first wall. The rack includes a rail having an angled edge configured to engage the edge of the hook.

In still another aspect, an interface between a guide shoe of a mining machine and a rack includes a first surface positioned on the guide shoe. and a second surface positioned on the rack. At least one of the first surface and the second surface including a profile oriented at an oblique angle relative to a plane of the rack.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
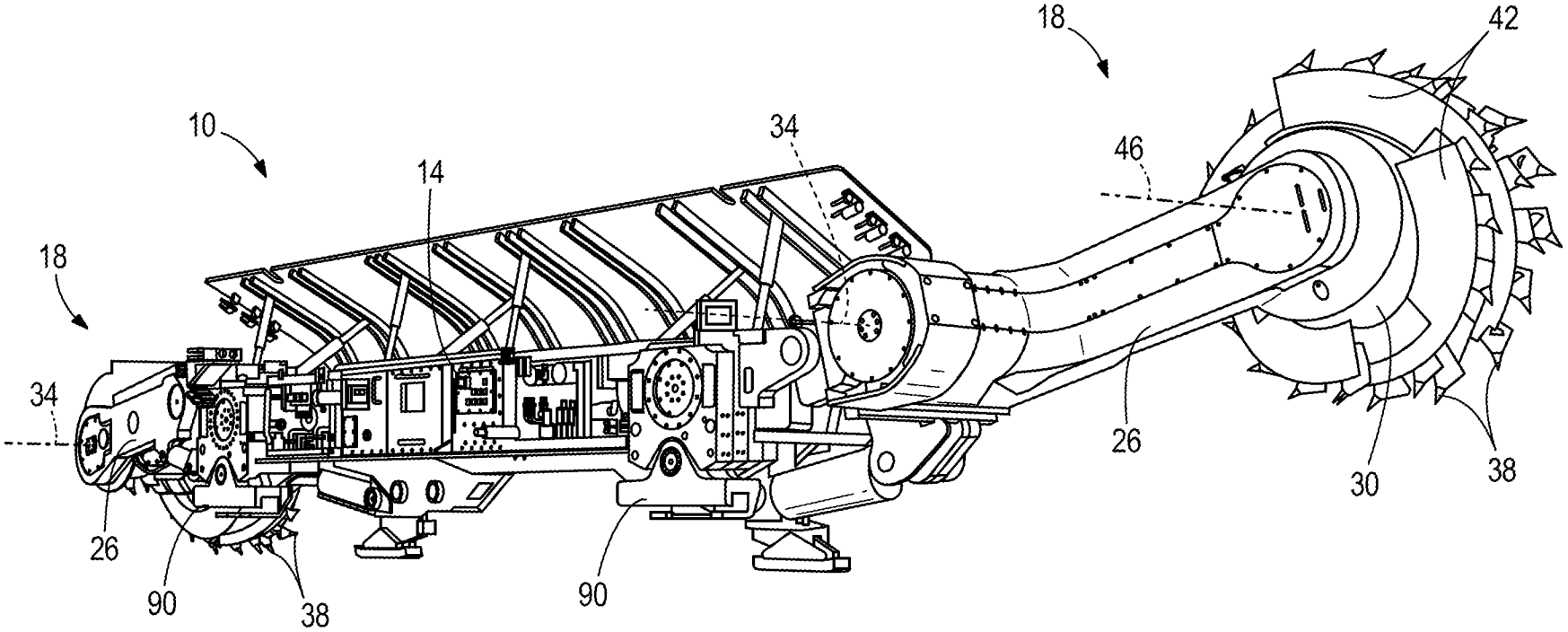
FIG. 1 is a perspective view of a mining machine.

FIG. 1 illustrates a mining machine, such as a longwall shearer 10. In the illustrated embodiment, the shearer 10 includes a chassis or frame 14 and a pair of cutting assemblies 18. Each cutting assembly 18 includes a ranging arm 26 and a cutting drum 30. Each ranging arm 26 is pivotably coupled to an associated end of the frame 14 and is pivotable about an associated arm axis 34. Each ranging arm 26 also supports the cutting drum 30 for rotation. Each cutting drum 30 includes a generally cylindrical body and cutting bits 38. In the illustrated embodiment, vanes 42 extend in a helical manner along an outer surface or periphery of the drum 30, and the cutting bits 38 are positioned along the edges of the vanes 42. The drum 30 is coupled to the ranging arm 26 and is rotatable about a drum axis 46 that is substantially parallel to the arm axis 34.

Figure 2:
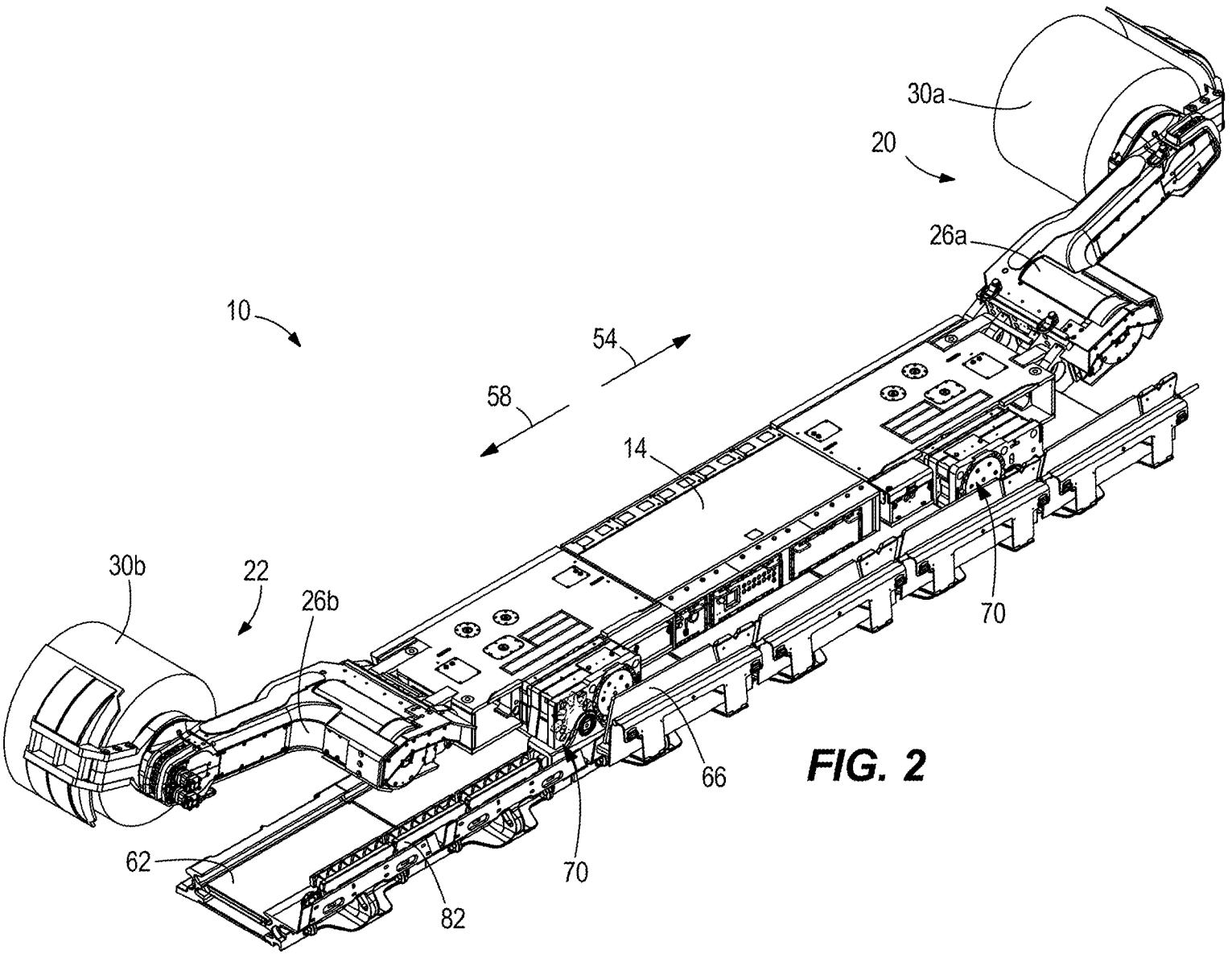
FIG. 2 is another perspective view of the mining machine of FIG. 1.
Figure 3:
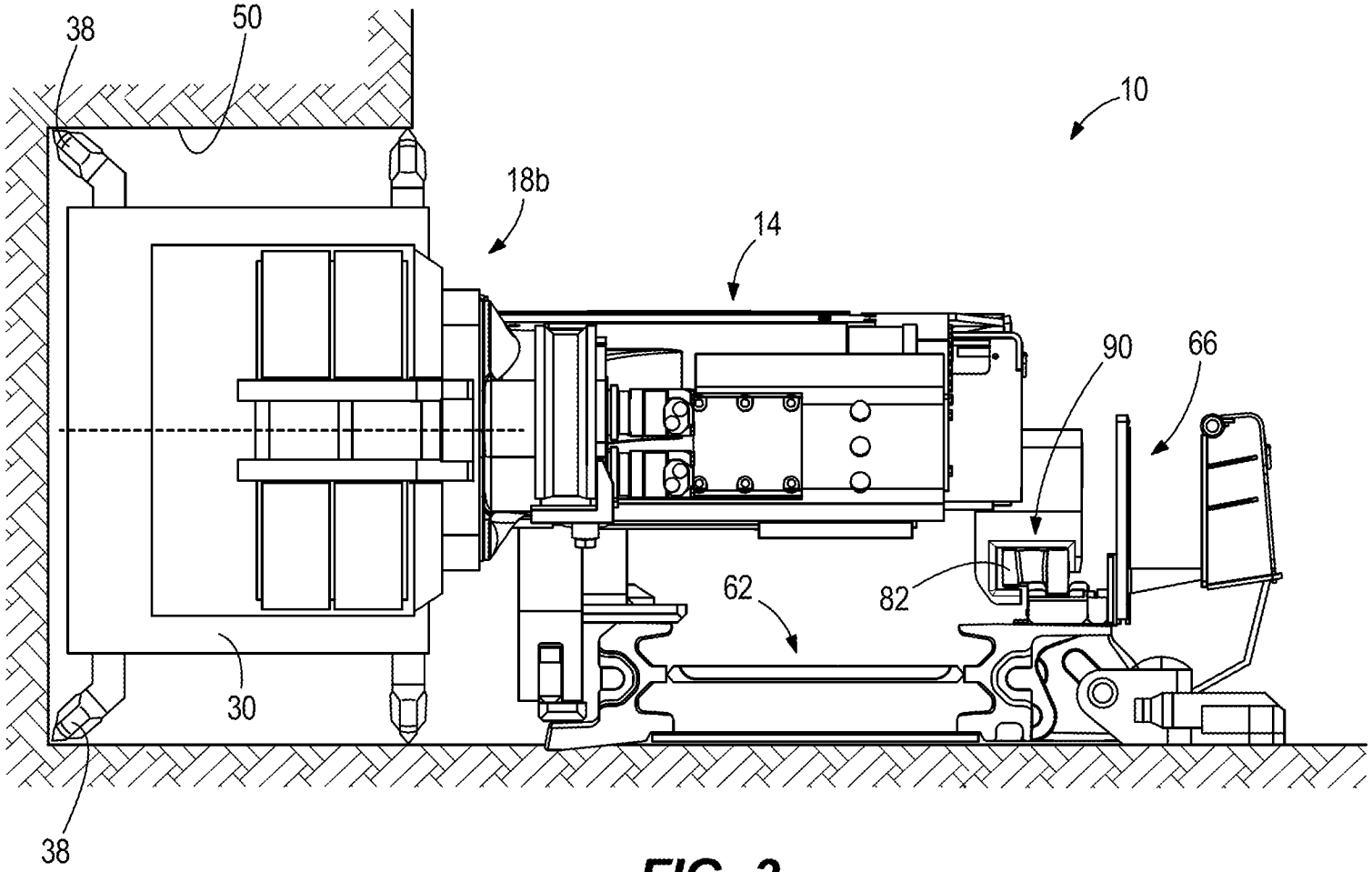
FIG. 3 is an end view of the mining machine of FIG. 1 engaging a mine wall.

As shown in FIGS. 2 and 3, the frame 14 is configured to tram or move along a mine face or wall 50 of material (FIG. 3) to be mined in a first direction 54 (FIG. 2) and a second direction 58 (FIG. 2). For simplicity, each drum 30 is illustrated as a cylinder in FIGS. 2 and 3. Each drum 30 engages the mine wall 50 such that the bits 38 (FIG. 1) cut material from the wall 50. As the cutting drum 30 rotates, the vanes 42 (FIG. 1) carry the cut material from the wall 50 toward a rear end of the drum 30, where the cut material is deposited onto a face conveyor 62. The face conveyor 62 may carry the material to another conveyor (e.g., a gate conveyor—not shown) to be transported out of the mine. In the illustrated embodiment, a spill plate 66 is positioned behind the frame 14 (i.e., away from the wall 50) to prevent cut material from falling behind the conveyor 62. In addition, a roof support (not shown) may have a base that is positioned behind the conveyor 62 and the spill plate 66 and a canopy extending over at least a portion of the mining machine 10.

As shown in FIG. 2, as the frame 14 moves in the first direction 54, a first cutting assembly 20 is in a leading position and a second cutting assembly 22 is in a trailing position. In one embodiment, the leading position is an elevated position in order to cut material, such as coal, from an upper portion of the mine wall 50, while the trailing position is a lower position to cut material from a lower portion of the mine wall 50.

Figure 4:
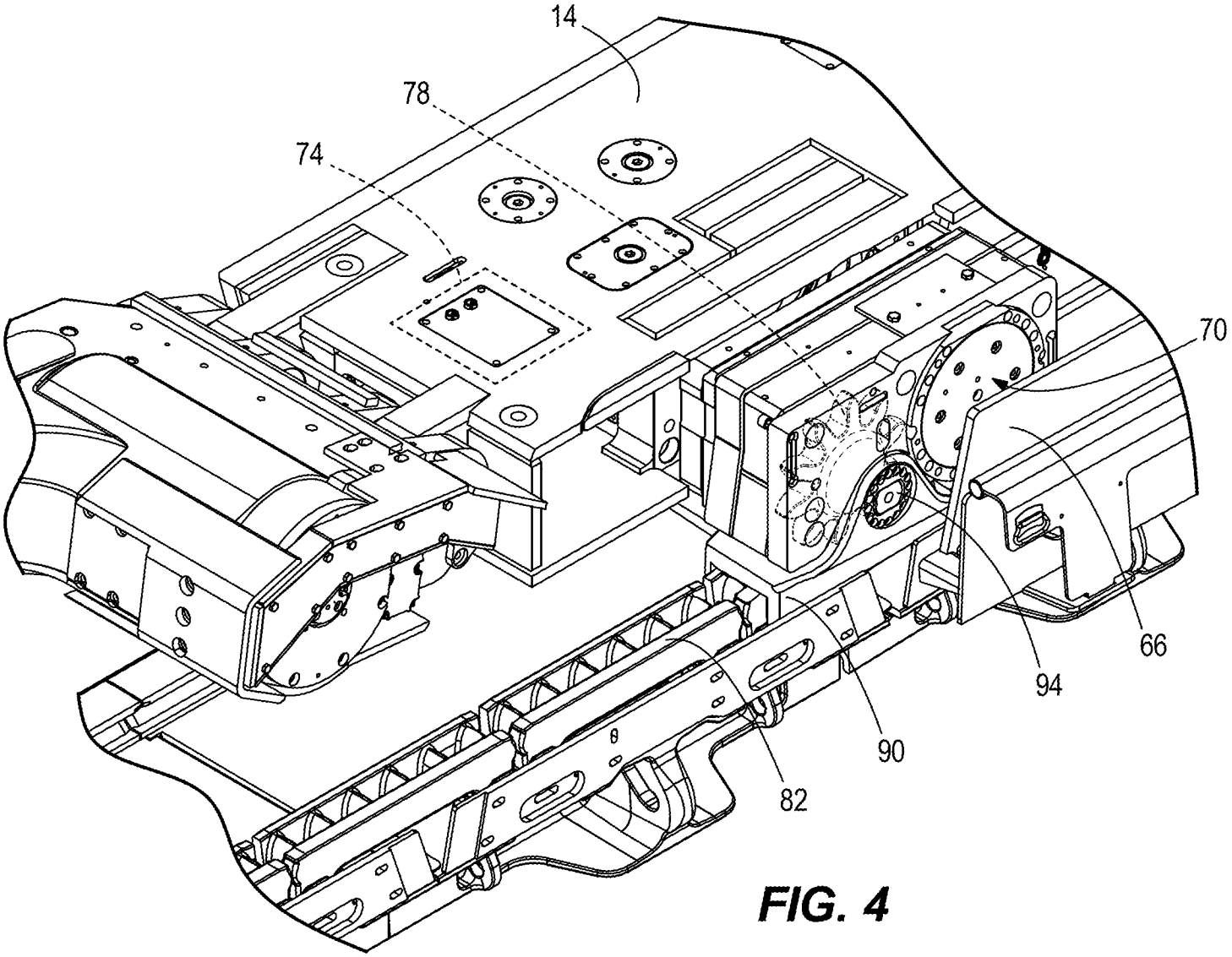
FIG. 4 is an enlarged perspective view of a portion of the mining machine of FIG. 1.
Figure 5:
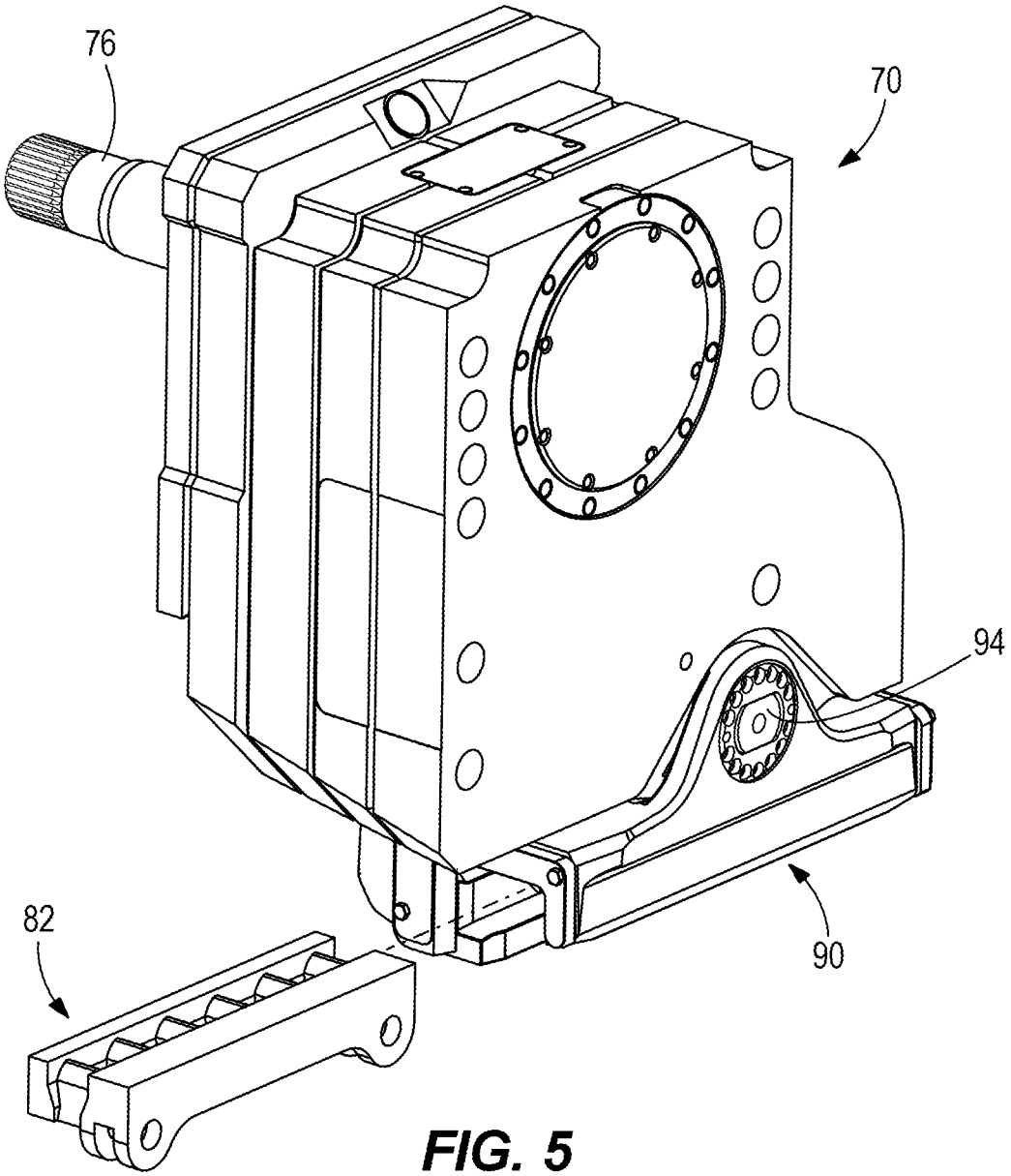
FIG. 5 is a perspective view of a drive mechanism.
Figure 6:
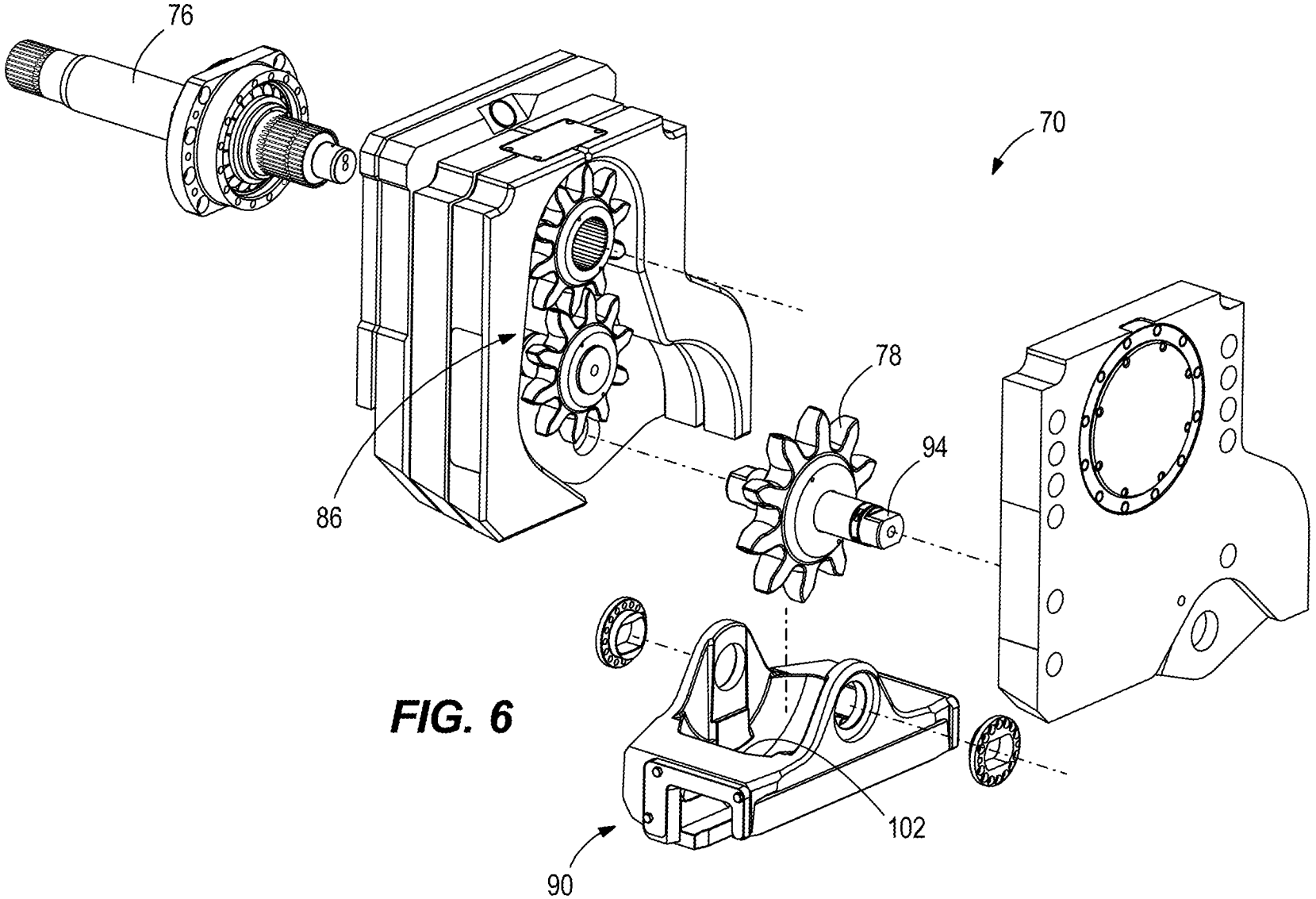
FIG. 6 is an exploded view of the drive mechanism of FIG. 5.

FIGS. 4-6 illustrate a drive mechanism 70 according to some embodiments. In the illustrated embodiment, the drive mechanism 70 may include a motor 74 (FIG. 4) driving an output shaft 76 (FIGS. 5 and 6), which in turn drives a gear or sprocket 78 (FIG. 6). In the illustrated embodiment, a rack 82 is coupled to the face conveyor 62 (FIG. 2) and extends along a portion of the face conveyor 62. The sprocket 78 (FIG. 4) engages the rack 82 to form a rack-and-pinion connection, such that rotation of the sprocket 78 causes translational movement of the frame 14 along the rack 82. In the illustrated embodiment, the output shaft 76 drives a gear train 86 (FIG. 6) that rotates the sprocket 78.

As shown in FIG. 5, a trapping shoe or guide shoe 90 is pivotably coupled to the frame 14 by a pin 94. The guide shoe 90 is slidably coupled to the rack 82. The sprocket 78 may be supported for rotation about the pin 94, and the teeth of the sprocket 78 extend through an opening 102 (FIG. 6) of the shoe 90 to engage the rack 82. The rack 82 also includes a plurality of rack teeth 96 that are spaced apart from one another by a gap, each of which is configured to receive a sprocket tooth. Among other things, the guide shoe 90 guides the movement of the frame 14 relative to the rack 82 along the mine face and maintains alignment and engagement between the sprocket 78 and the rack 82. In the illustrated embodiment, a guide shoe 90 is positioned proximate each end of the frame 14. In other embodiments, the mining machine 10 may include fewer or more guide shoes.

The rack may be formed as multiple rack portions or rackbars 82 (FIG. 4) aligned with one another in an end-to-end relationship. As shown in FIGS. 7A-7B and 9A-9B, in the illustrated embodiment, the rack 82 may include a first rail 98, a second rail 102 oriented parallel to the first rail 98, and the rack teeth 96 positioned between the first rail 98 and second rail 102. The first and second rails 98, 102 are generally rectangular and extend from a first end 83 of the rack 82 to a second, opposite end 85 of the rack 82. Two lugs 104 may protrude (e.g., from a lower surface of the first rail 98), and one of the lugs 104 may be positioned adjacent the first end 83 and the other of the lugs 104 is positioned adjacent the second end 85.

As shown in FIGS. 7A-7B and 9A-9B, a distal end 103 of the second rail 102 includes a first edge or base edge 106, a second edge or upper edge 108, a third edge or inner edge 110, and a fourth edge or outer edge 112. As shown in the illustrated embodiments, the second edge 108 is oriented substantially perpendicular to the fourth edge 112. Further, as shown in the illustrated embodiments, an edge 114 of one of the teeth 96 positioned adjacent the distal end 103 of the second rail 102 extends between the third edge 110 and the first rail 98. In the illustrated embodiments, the first edge 106 is generally planar and oriented parallel to the tooth edge 114 and the second edge 108. However, in some embodiments (discussed below), the first edge 106 may be oriented at an angle relative to the tooth edge 114 and the second edge 108, and/or the first edge 106 may have a non-planar profile (e.g., curved).

Figure 7A:
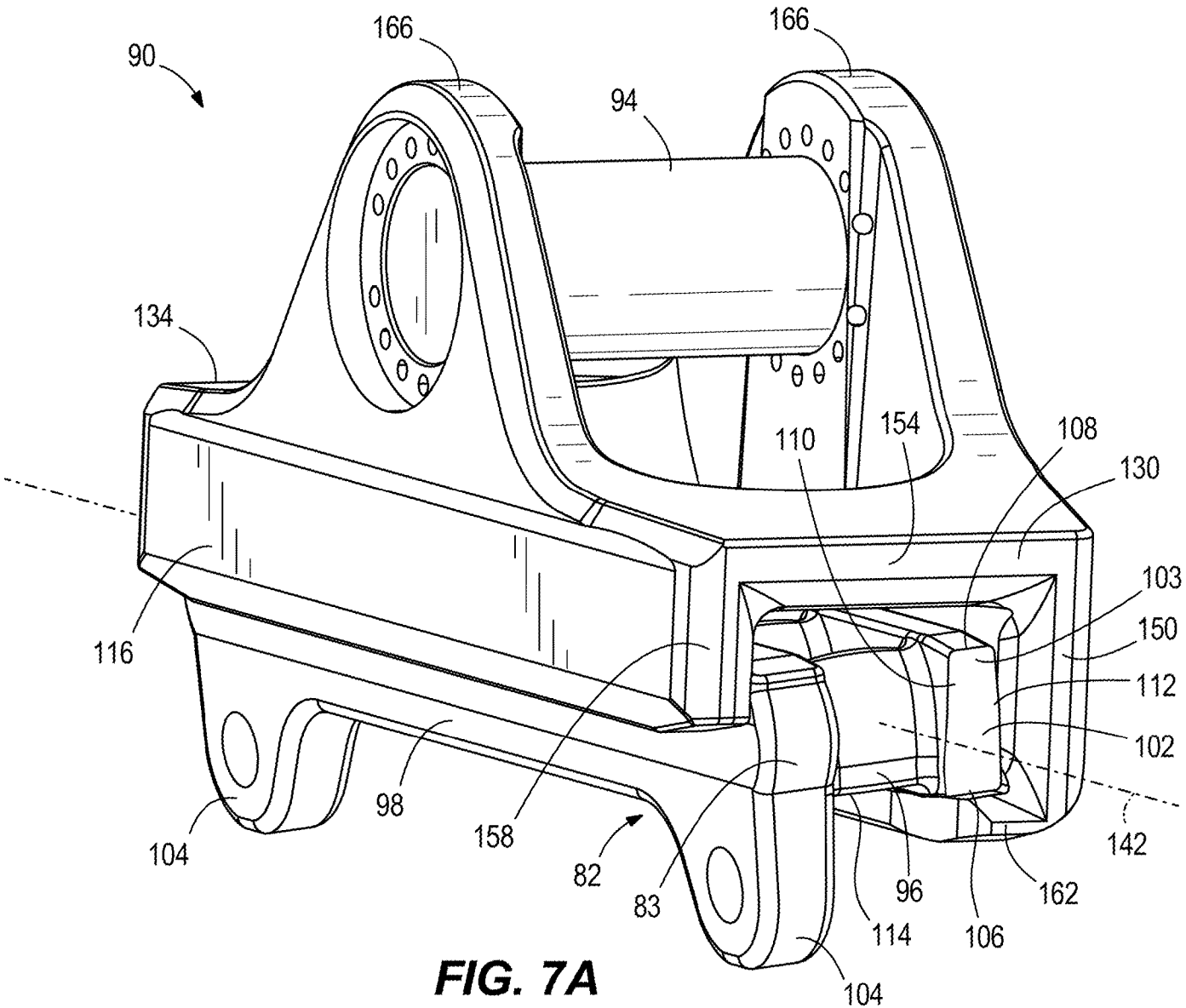
FIG. 7A is a perspective view of a guide shoe and a rack, according to an aspect of the invention.
Figure 7B:
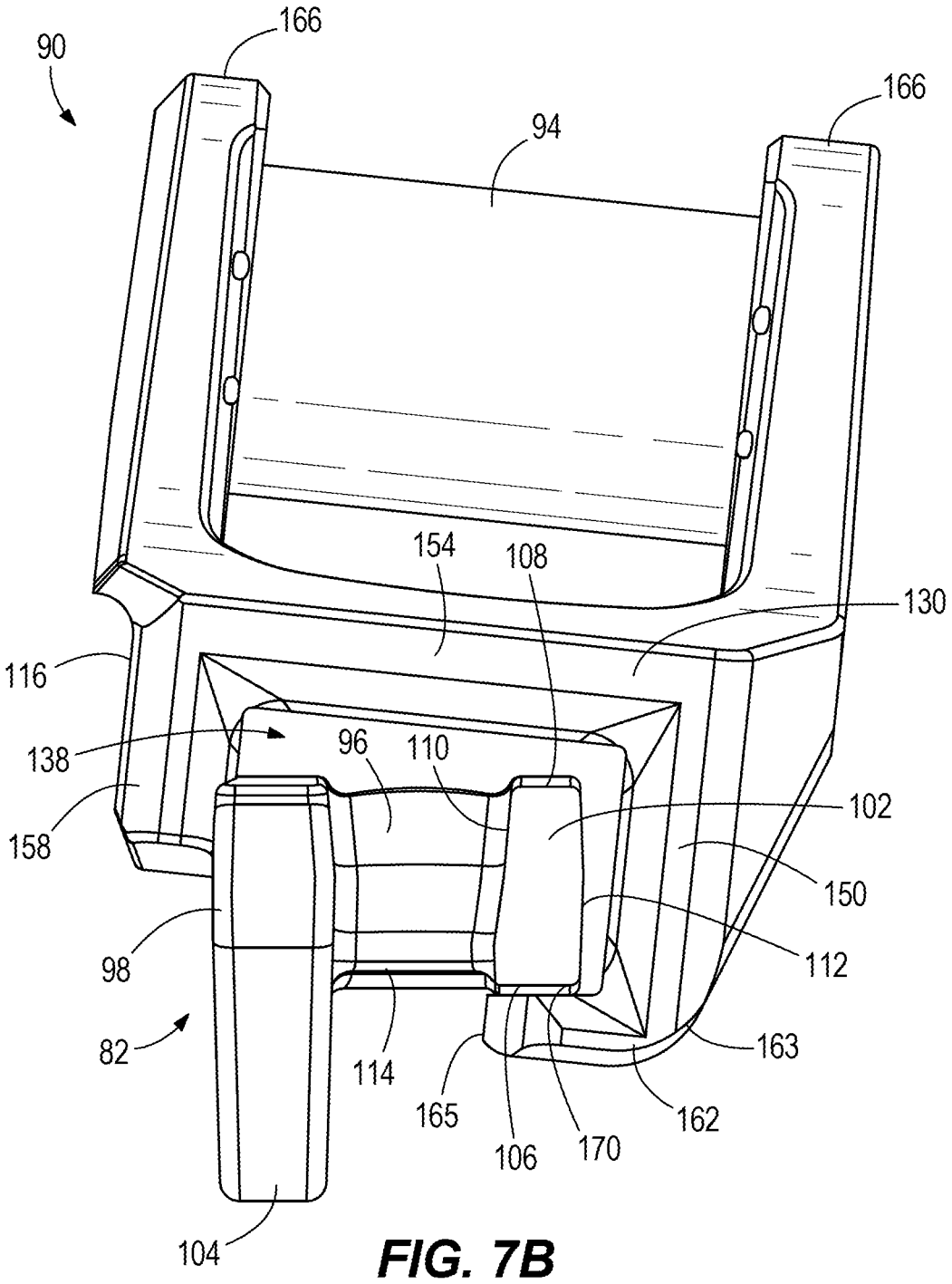
FIG. 7B is an end view of the guide shoe and rack of FIG. 7A.
Figure 8B:
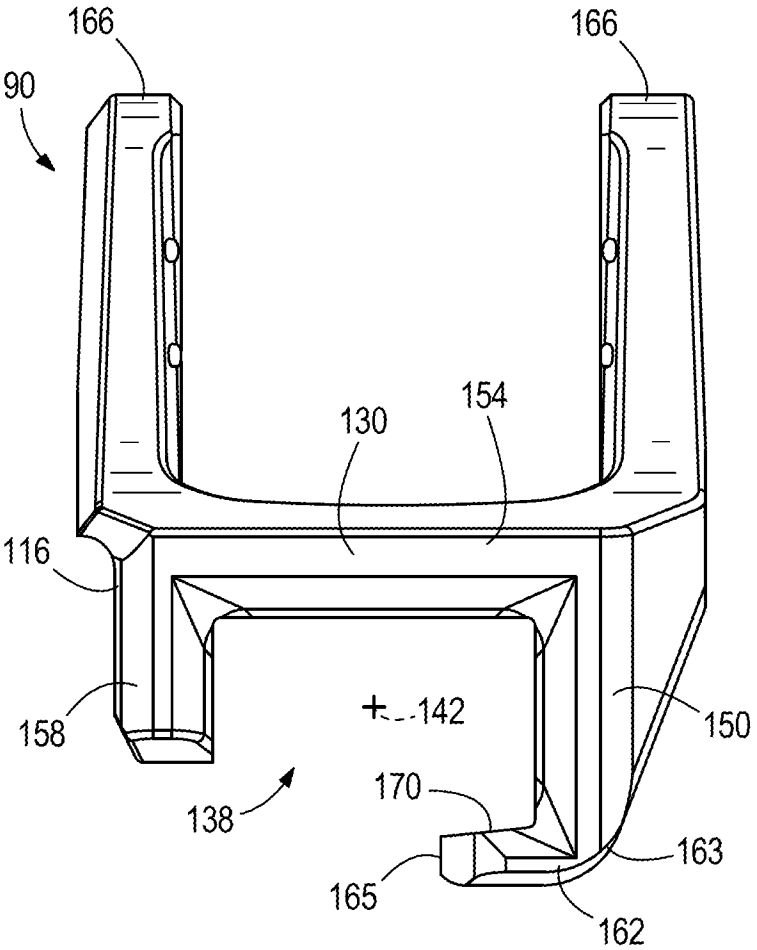
FIG. 8B is an end view of the guide shoe of FIG. 8A.
Figure 8A:
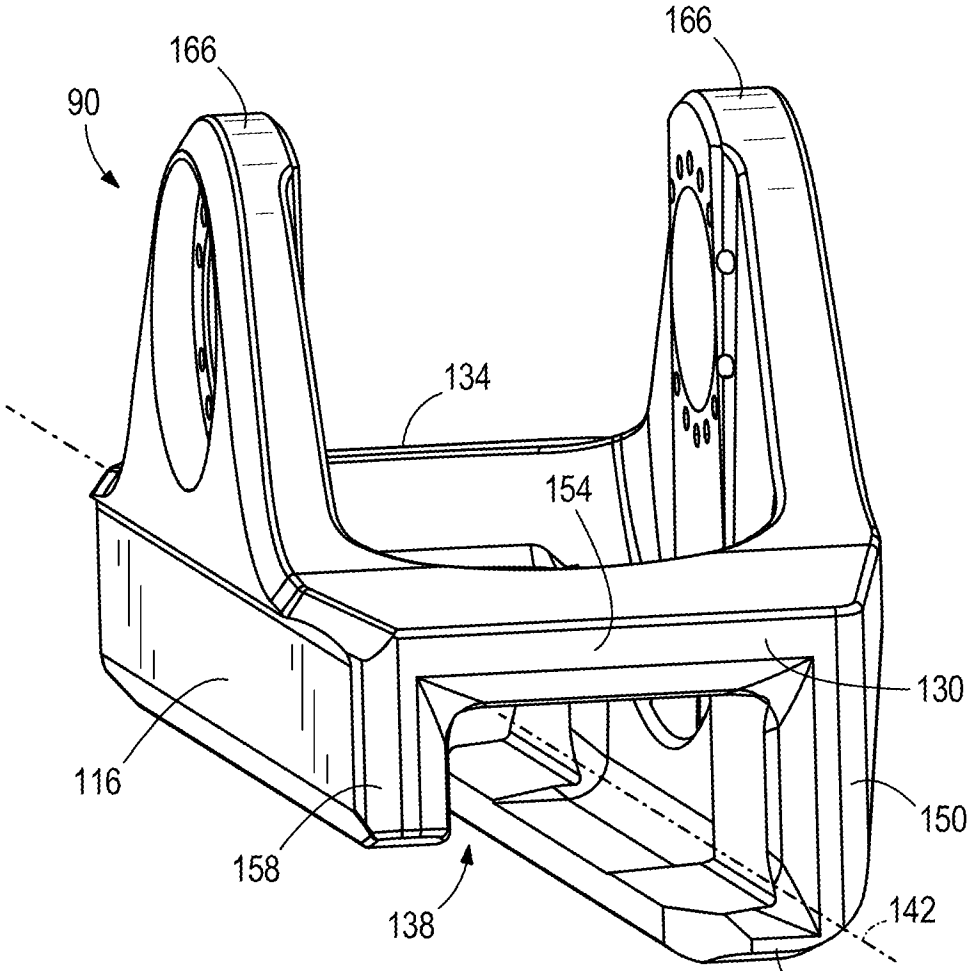
FIG. 8A is a perspective view if the guide shoe of FIG. 7A.
Figure 9A:
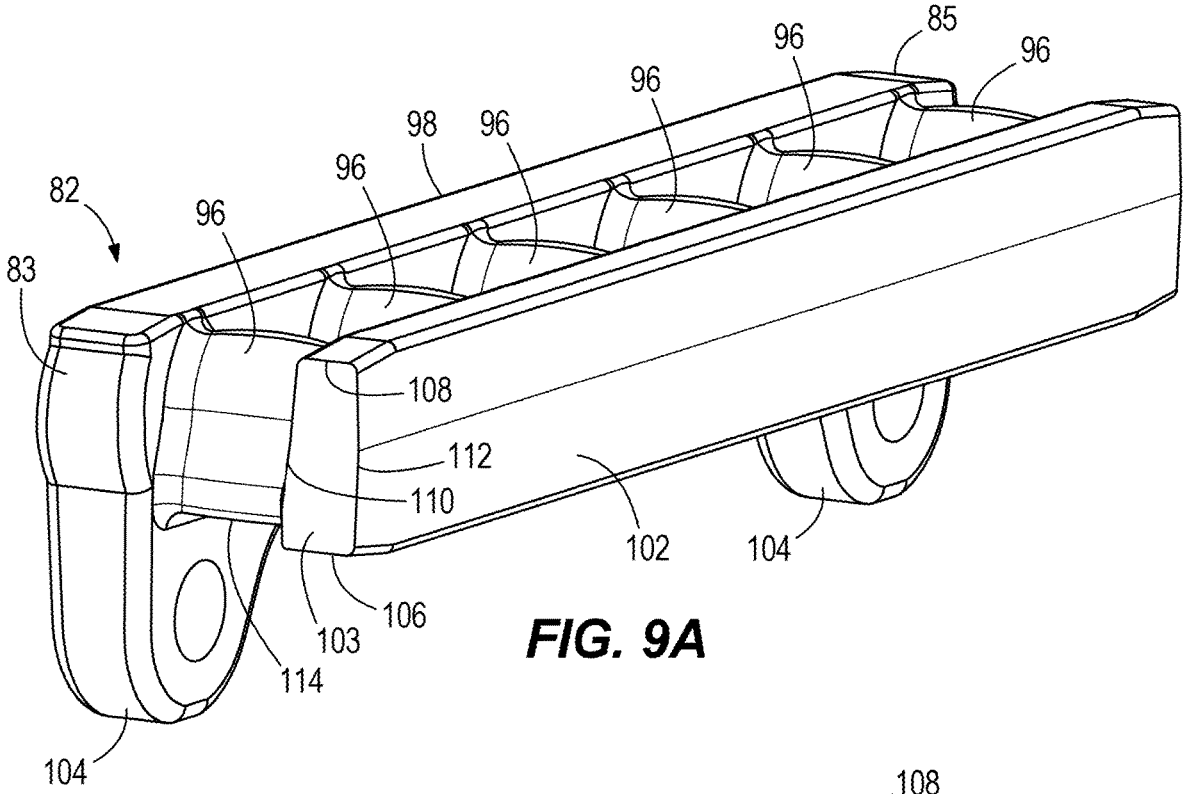
FIG. 9A is a perspective view of the rack of FIG. 7A.
Figure 9B:
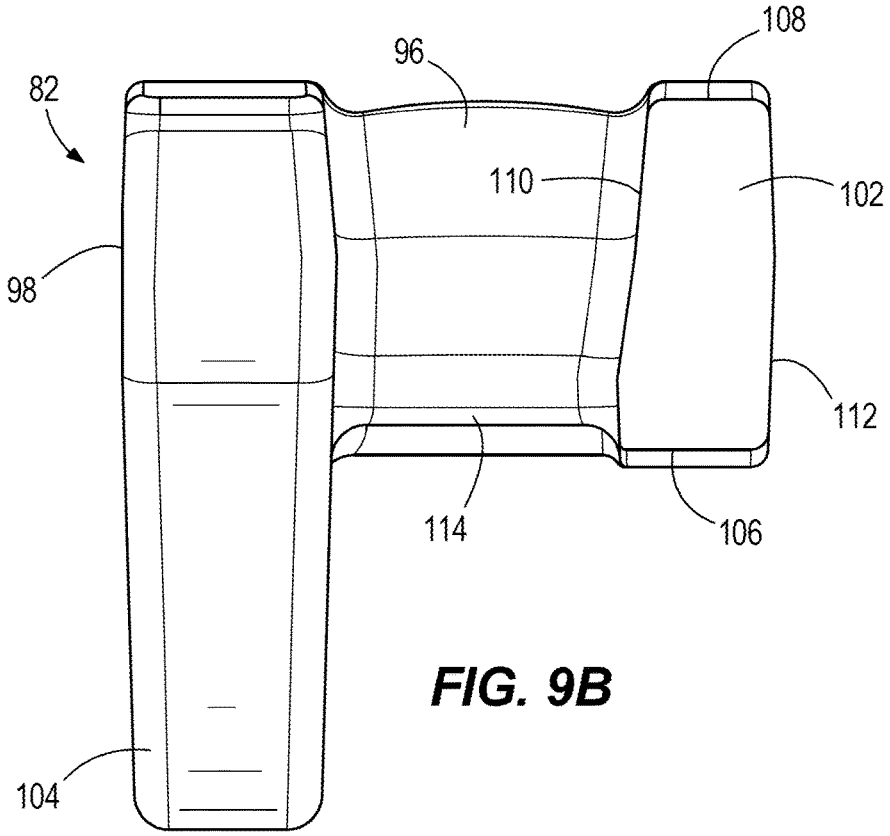
FIG. 9B is an end view of the rack of FIG. 9A.

Referring to FIGS. 7A-8B, the guide shoe 90 includes a shoe body 116 having a first end 130 and a second end 134 (FIGS. 7A and 8A). In addition, a slot 138 extends longitudinally between the first end 130 and the second end 134 along a slot axis 142 (FIG. 7A). As used herein, the term "axial" and variants thereof refers to a direction that is parallel to the slot axis 142, and the term "radial" and variants thereof refers to a direction that is perpendicular to the slot axis 142. The slot 138 is sized to receive the rack 82 (FIG. 3). In the illustrated embodiment, a cross-section of the slot 138 transverse to the slot axis 142 forms an incomplete or non-enclosed shape (e.g., a rectangular shape having an incomplete perimeter). In the illustrated embodiment, the pin 94 is positioned between the first end 130 and the second end 134.

As shown in FIGS. 7A-8B, the shoe body 116 includes a first wall or base wall 150, a second wall or upper wall 154, a third wall or lateral guide wall 158, and a fourth wall or hook 162. In the illustrated embodiment, the base wall 150 and the upper wall 154 are connected together and oriented perpendicular to one another. Lugs 166 extend from an upper surface of the upper wall 154, and the pin 94 extends between the lugs 166. The lateral guide wall 158 protrudes from the upper wall 154 in a direction parallel to the base wall 150. The lateral guide wall 158 is spaced apart from the base wall 150 and extends parallel to the slot axis 142. The hook 162 protrudes from the base wall 150. The slot 138 is generally formed in a space between the base wall 150, the upper wall 154, the lateral guide wall 158, and the hook 162.

With reference to FIGS. 7B and 8B, the hook 162 protrudes from the base wall 150 in a direction orthogonal to the upper wall 154. As best shown in FIG. 8B, a surface 170 of the hook 162 is substantially planar and is inclined. Stated another way, the surface 170 is oriented at an oblique or non-parallel angle relative to the upper wall 154. The hook surface 170 is slanted away from the upper wall 154 (e.g., downwardly) from a first end 163 of the hook 162, adjacent the base wall 150, to a second, or distal, end 165 of the hook 162. In other embodiments, the hook 162 may have a different configuration.

In some embodiments, the guide shoe 90 may be constructed as a single, unitary piece. In some embodiments, the guide shoe 90 may include a wear insert or wear sleeve and a retainer that are removably coupled to the shoe body 116. In some embodiments, the wear sleeve may be axially received within the slot 138 from one end of the shoe body 116, and the retainer may be positioned adjacent the end of the shoe body to secure the wear sleeve to the shoe body 116 (e.g., by fasteners). Although the drawings illustrate the first end 130 of the shoe body 116, it is understood that the guide shoe 90 may be substantially similar on the second end 134 of the shoe body 116.

During operation, the hook 162 is positioned adjacent a lower surface of the rack 82 (FIG. 3), and the lateral guide wall 158 is positioned adjacent a side surface of the rack 82 (e.g., a rearward facing surface of the rack 82). The hook 162 maintains positive engagement between the sprocket 78 and the rack 82 while the shoe 90 slides relative to the rack 82.

As shown in FIGS. 7A and 7B, when the rack 82 is positioned within the slot 138 of the shoe 90, the base edge 106 of the second rail 102 of the rack 82 engages the hook surface 170. That is, the profiled surface (e.g., the inclined surface 170) of the hook 162 engages with the base edge 106 of the second rail 102. The surface 170 of the hook 162 facilitates secure engagement between the hook 162 and the rack 82, thereby minimizing misalignment that may occur due to wear.

In a conventional mining machine, wear at the interface between a rack and a guide shoe may reduce a working life of the shoe and/or may negatively affect the engagement between the shoe and the rack, thereby causing misalignment. The hook 162 illustrated in FIGS. 8A and 8B reduces wear at the interface between the rack 82 and the guide shoe 90, thereby extending the working life of the rack 82 and/or guide shoe 90 and reduces the frequency with which the shoe 90 must be replaced. Further, the reduced wear will enable the guide shoe 90 to maintain proper meshing engagement between the sprocket 78 and the rack 82, thereby improving machine 10 control and reducing wear on the sprocket 78.

In some embodiments, the rack and/or the hook may have a different configuration. For example, FIGS. 10A-12B illustrate a guide shoe 90*a* and rack 82*a* according to another embodiment. Specifically, FIGS. 10A-12B illustrate a rack 82*a* having an inclined surface. For the sake of brevity, some of the differences between the guide shoe 90*a* and guide shoe 90, and the rack 82*a* and the rack 82, are described. Similar features are labeled with similar reference numbers, plus the suffix 'a'.

Figure 10A:
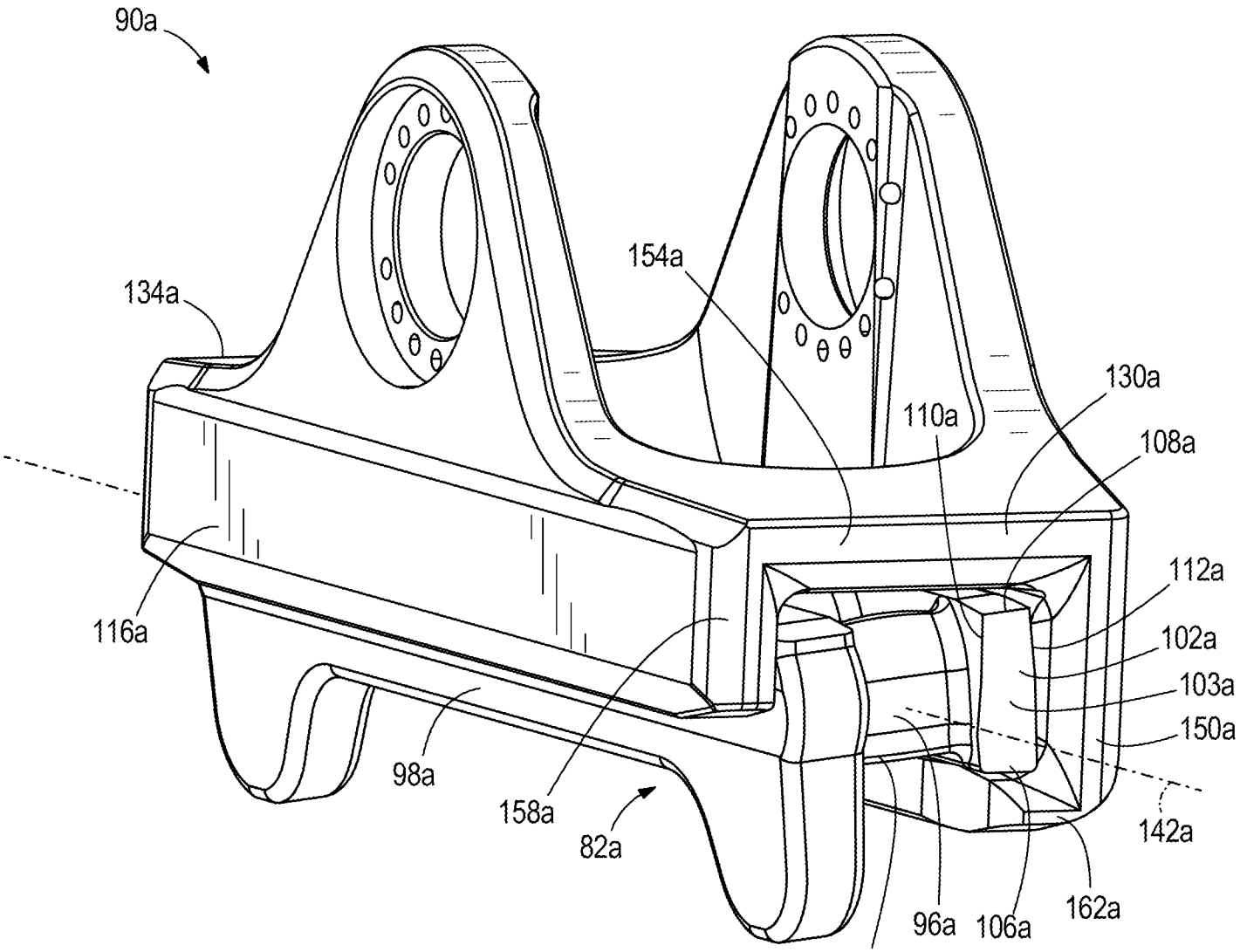
FIG. 10A is a perspective view of a guide shoe and a rack, according to another embodiment.
Figure 10B:
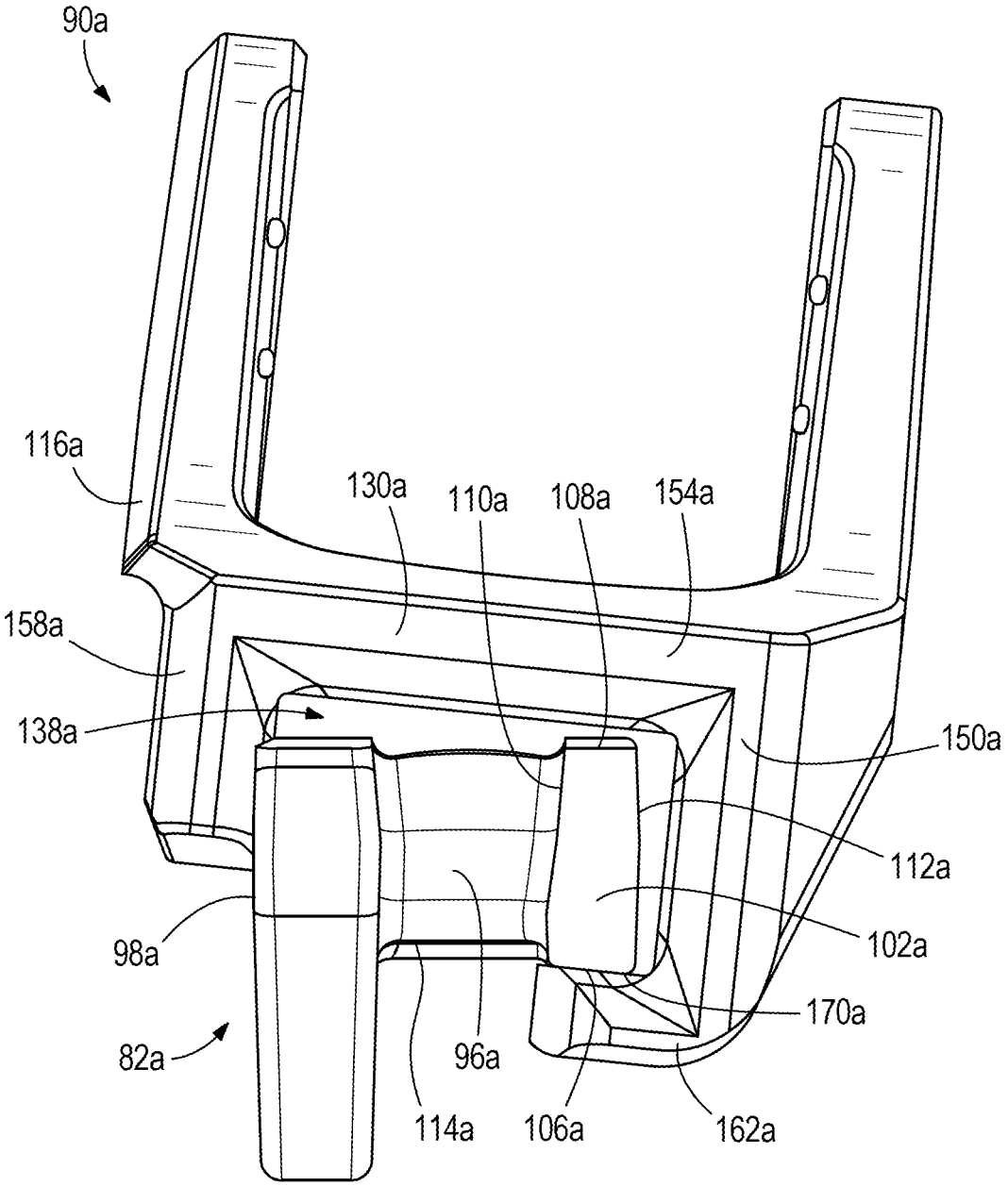
FIG. 10B is an end view of the guide shoe and rack of FIG. 10A.
Figure 12A:
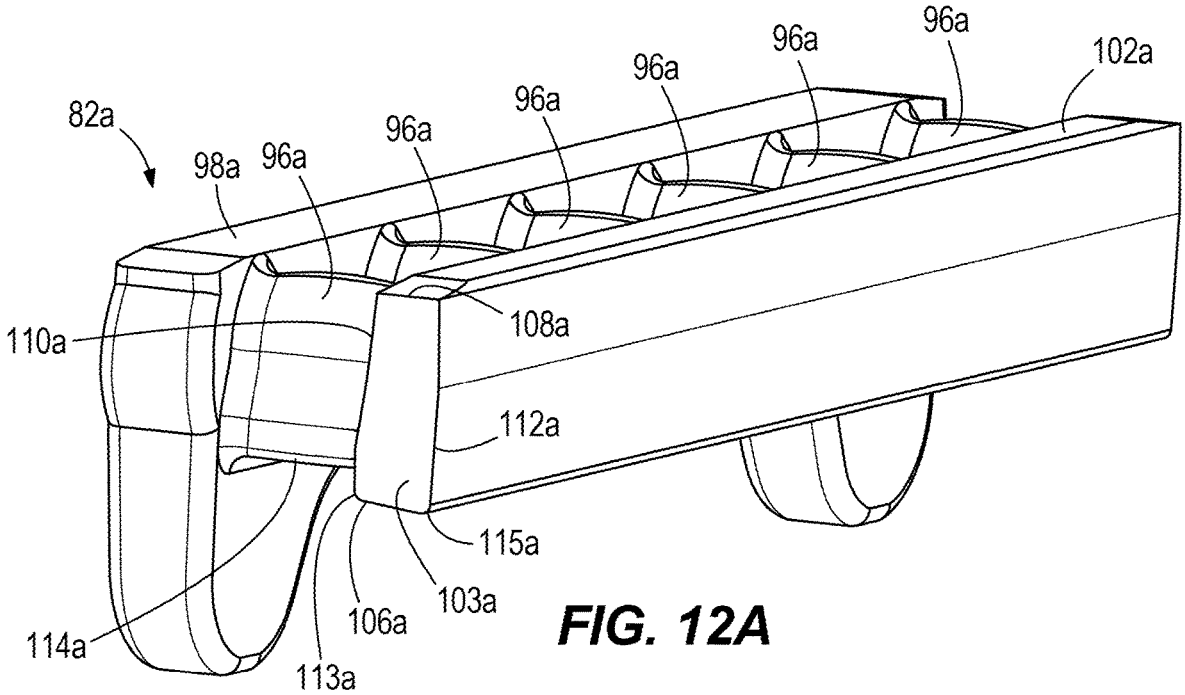
FIG. 12A is a perspective view of the rack of FIG. 10A.
Figure 12B:
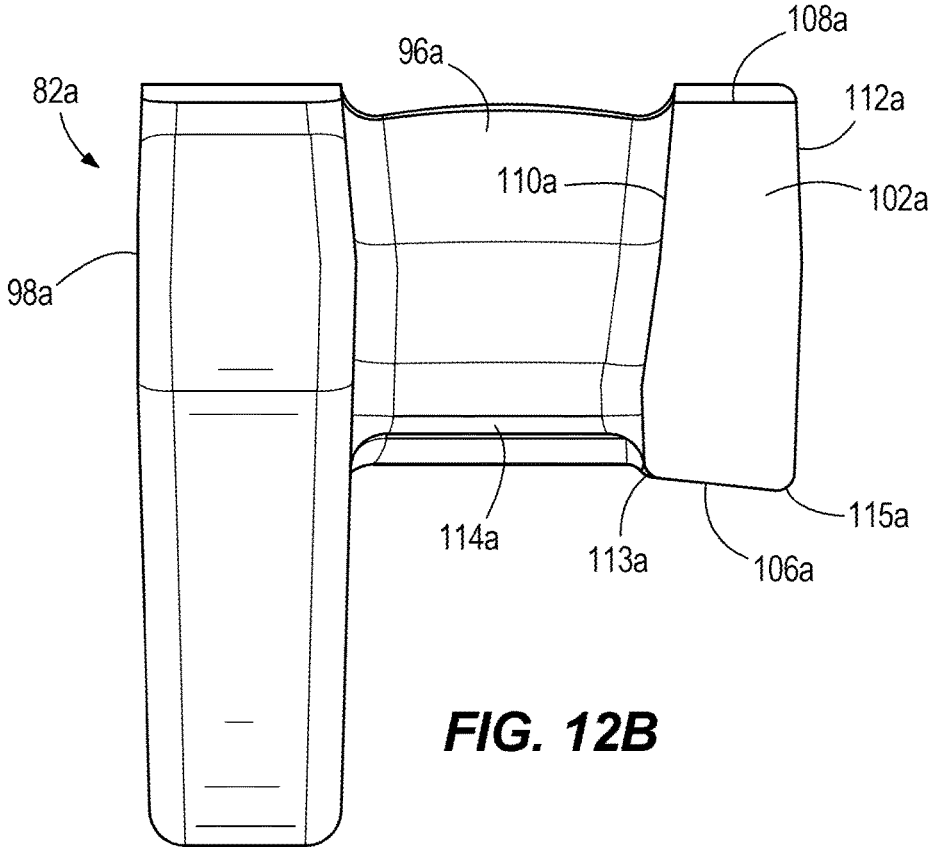
FIG. 12B is an end view of the rack of FIG. 12A.

Referring to FIGS. 10A-10B and 12A-12B, the rack 82*a* includes a first rail 98*a*, a second rail 102*a*, and rack teeth 96*a*, similar to the rack 82 described above. A distal end 103*a* of the second rail 102*a* includes a first edge or base edge 106*a*, a second edge or upper edge 108*a*, a third edge or inner edge 110*a*, and a fourth edge or outer edge 112*a*. An edge 114*a* of one of the teeth 96*a* positioned adjacent the distal end 103*a* of the second rail 102*a* extends between the third edge 110*a* and the first rail 98*a*. As best shown in FIGS. 10B and 12B, the first edge 106*a* is generally planar and is oriented at an oblique angle (e.g., non-parallel) relative to the second edge 108*a*. Stated another way, the first edge 106*a* is inclined between a first end 113*a* of the first edge 106*a*, adjacent the teeth 96*a*, to a second, or distal end 115*a* of the first edge 106*a*, and the first edge 106*a* proximate the first end 113*a* is closer to the second edge 108*a* than the first edge 106*a* proximate the second end 115*a*.

Figure 11B:
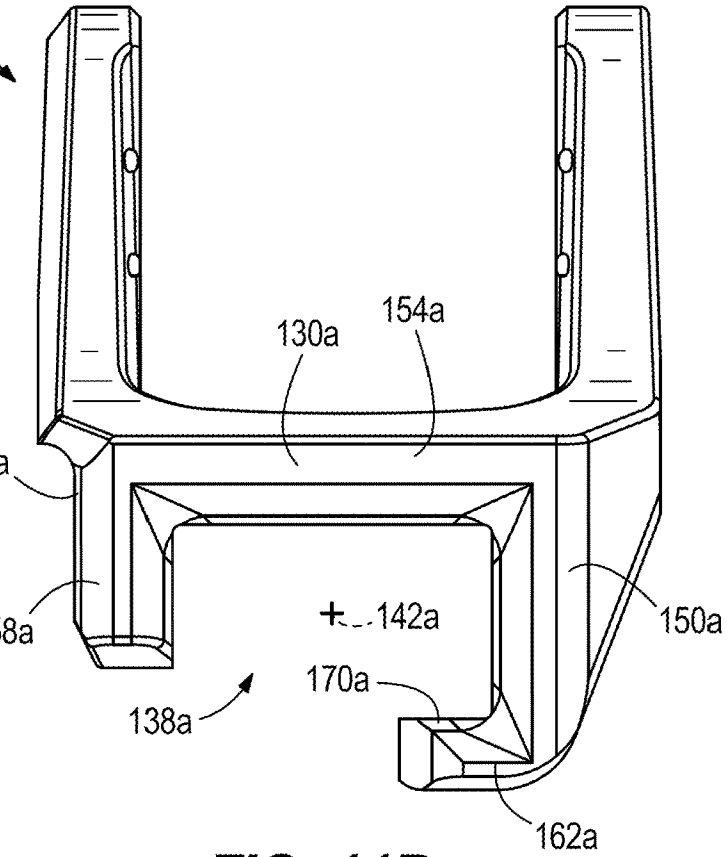
FIG. 11B is an end view of the guide shoe of FIG. 11A.
Figure 11A:
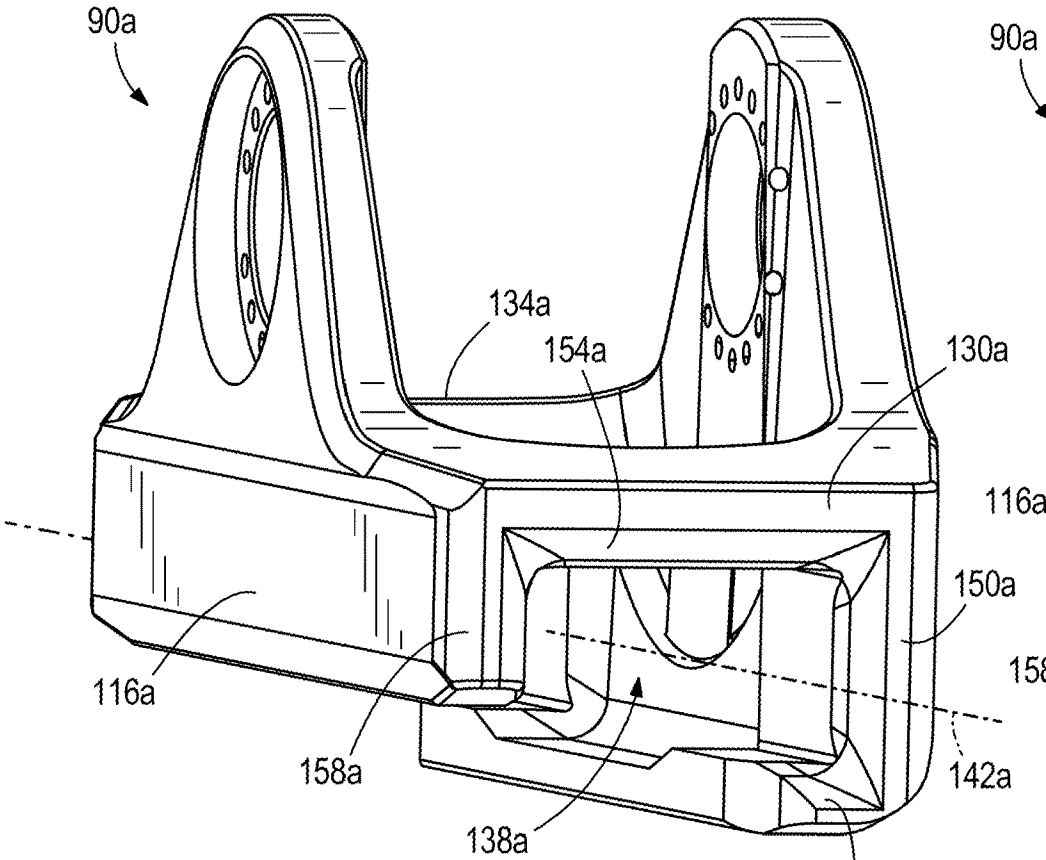
FIG. 11A is a perspective view if the guide shoe of FIG. 10A.

Referring to FIGS. 10A-11B, the guide shoe 90*a* includes a shoe body 116*a* having a first end 130*a* and a second end 134*a*. A slot 138*a* extends longitudinally between the first end 130*a* and the second end 134*a* along a slot axis 142*a*. The shoe body 116*a* includes a first wall or base wall 150*a*, a second wall or upper wall 154*a*, a third wall or lateral guide wall 158*a*, and a fourth wall or hook 162*a*. The lateral guide wall 158*a* protrudes from the upper wall 154*a* in a direction parallel to the base wall 150*a*. The lateral guide wall 158*a* is spaced apart from the base wall 150*a* and extends parallel to the slot axis 142*a*. The hook 162*a* protrudes from the base wall 150*a*. The slot 138*a* is generally formed between the base wall 150*a*, the upper wall 154*a*, the lateral guide wall 158*a*, and the hook 162*a*. With reference to FIGS. 10B and 11B, the hook 162*a* protrudes from the base wall 150*a* in a direction orthogonal to the upper wall 154*a*. A surface 170*a* of the hook 162*a* may be oriented substantially parallel to the upper wall 154*a*.

During operation, the hook 162*a* is positioned adjacent a lower surface of the rack 82*a* (FIG. 3), and the lateral guide wall 158*a* is positioned adjacent a side surface of the rack 82*a* (e.g., a rearward facing surface of the rack 82*a*). The hook 162*a* maintains positive engagement between the sprocket 78 and the rack 82*a* while the shoe 90*a* slides relative to the rack 82*a*.

As shown in FIGS. 10A and 10B, when the rack 82*a* is positioned within the slot 138*a* of the shoe 90*a*, the base edge 106*a* of the second rail 102*a* of the rack 82*a* engages the surface 170*a* of the hook 162*a*. That is, the profiled surface (e.g., the base edge 106*a*) of the second rail 102*a* of the rack 82*a* engages with the surface 170*a* of the hook 162*a*. The inclined surface 106*a* of the second rail 102*a* facilitates engagement between the rack 82*a* and the hook 162*a*, thereby minimizing misalignment that may occur due to wear.

FIGS. 13A-15B illustrate a guide shoe 90*b* and rack 82*b* according to another embodiment. Specifically, FIGS. 13A-15B illustrate a profiled surface provided on the rack 82*b* and provided on the hook 162*b* of the guide shoe 90*b*. For the sake of brevity, some of the differences between the guide shoe 90*b* and guide shoe 90, and the rack 82*b* and the rack 82 are described. Similar features are labeled with similar reference numbers, plus the suffix 'b'.

Figure 13A:
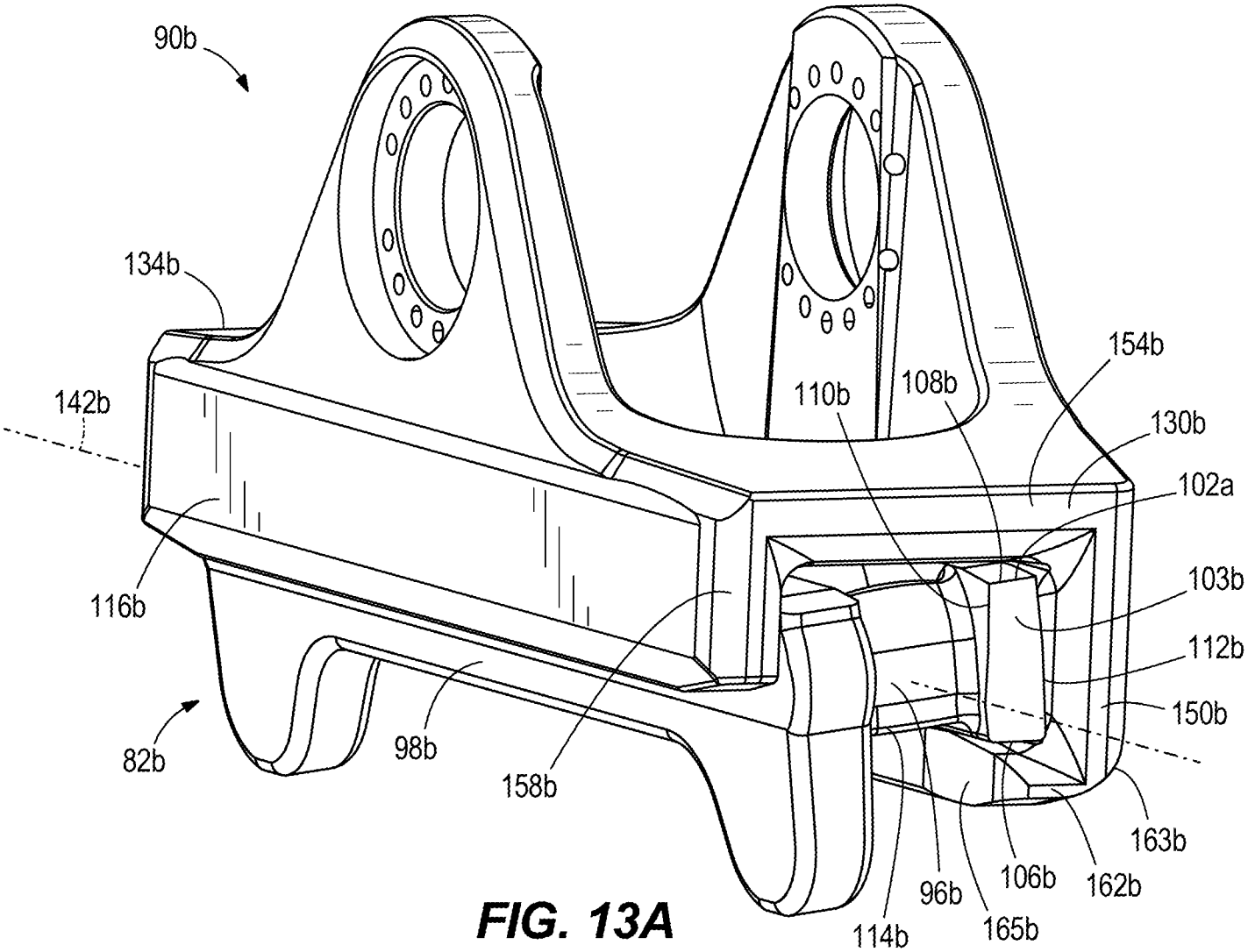
FIG. 13A is a perspective view of a guide shoe and a rack, according to another embodiment.
Figure 13B:
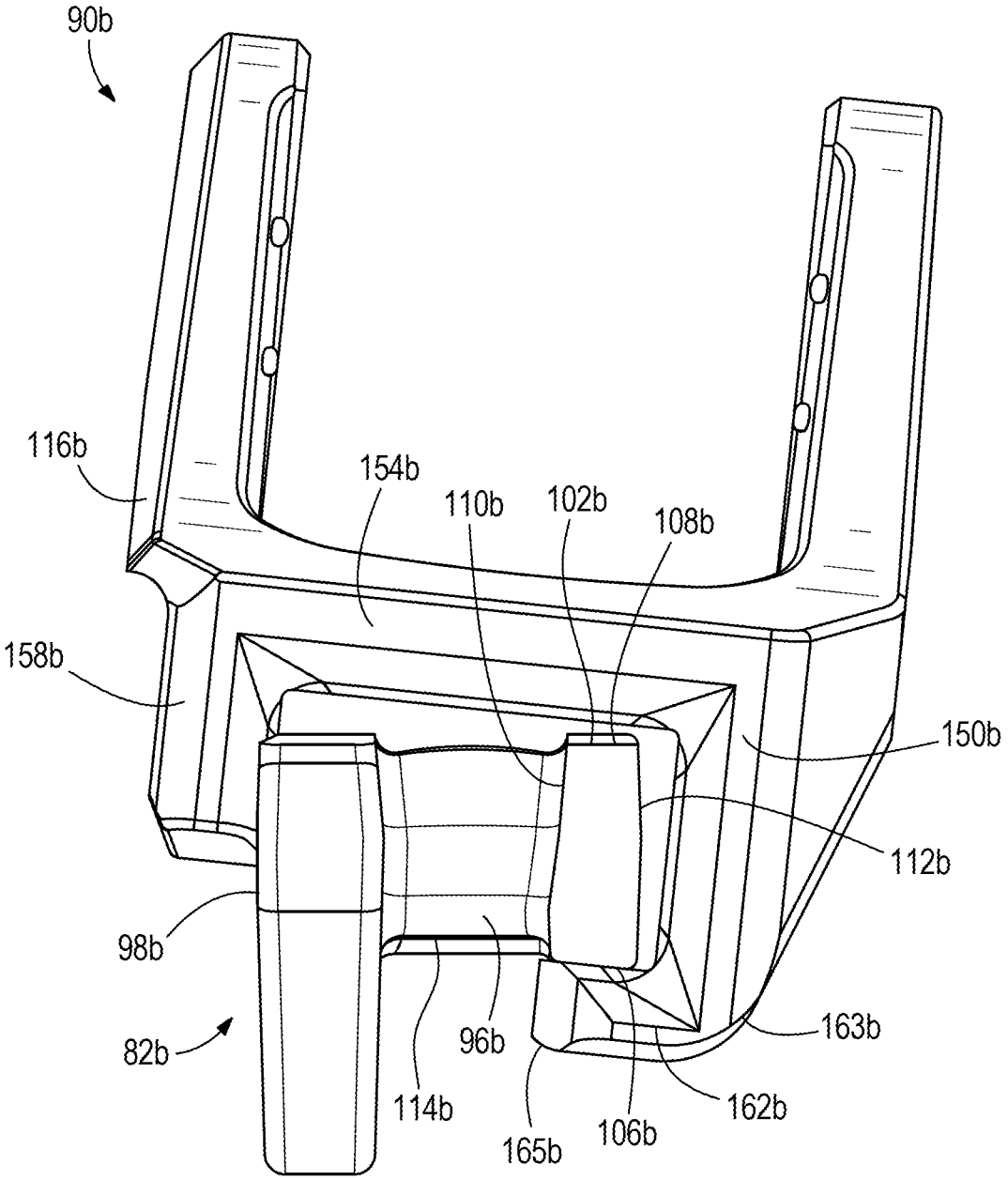
FIG. 13B is an end view of the guide shoe and rack of FIG. 13A.
Figure 15A:
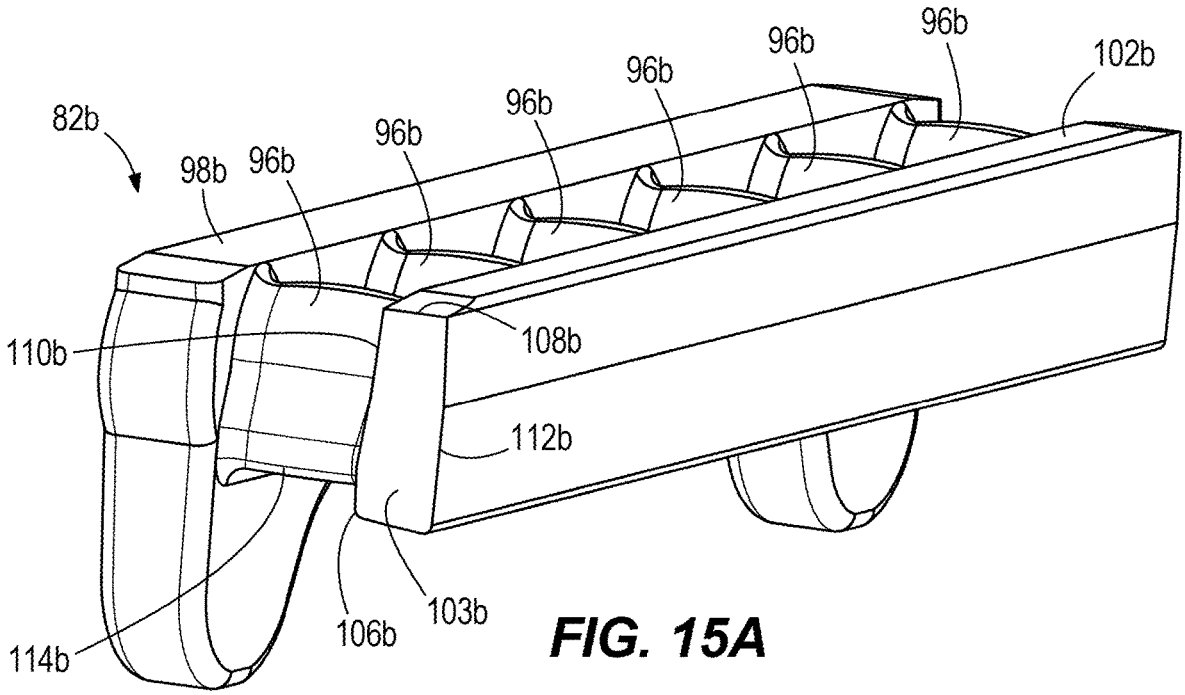
FIG. 15A is a perspective view of the rack of FIG. 13A.
Figure 15B:
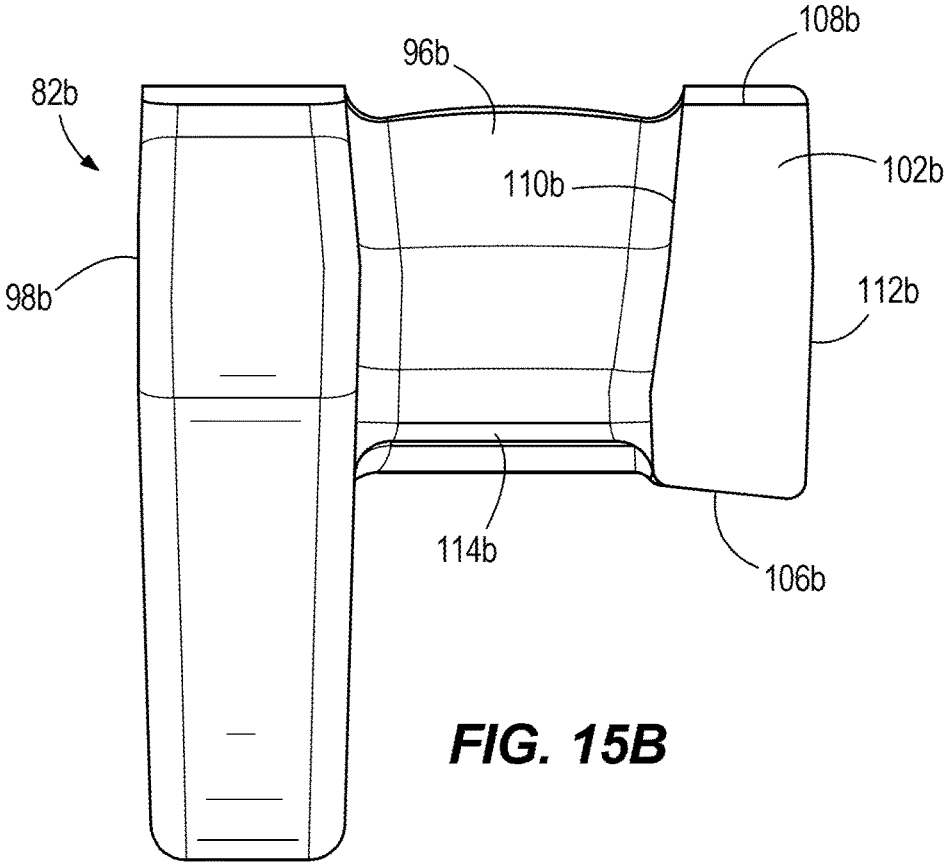
FIG. 15B is an end view of the rack of FIG. 15A.

Referring to FIGS. 13A-13B and 15A-15B, the rack 82*b* includes a first rail 98*b*, a second rail 102*b*, and rack teeth 96*b*, similar to the rack 82 described above. A distal end 103*b* of the second rail 102*b* includes a first edge or base edge 106*b*, a second edge or upper edge 108*b*, a third edge or inner edge 110*b*, and a fourth edge or outer edge 112*b*. An edge 114*b* of one of the teeth 96*b* positioned adjacent the distal end 103*b* of the second rail 102*b* extends between the third edge 110*b* and the first rail 98*b*. As best shown in FIGS. 13B and 15B, the first edge 106*b* is generally planar and is oriented at an oblique angle (e.g., non-parallel) relative to the second edge 108*b*. Stated another way, the first edge 106*b* is inclined between a first end 113*b* of the first edge 106*b*, adjacent the teeth 96*b*, to a second, or distal end 115*b* of the first edge 106*b*, and the first edge 106*b* proximate the first end 113*b* is closer to the second edge 108*b* than the first edge 106*b* proximate the second end 115*b*.

Figure 14B:
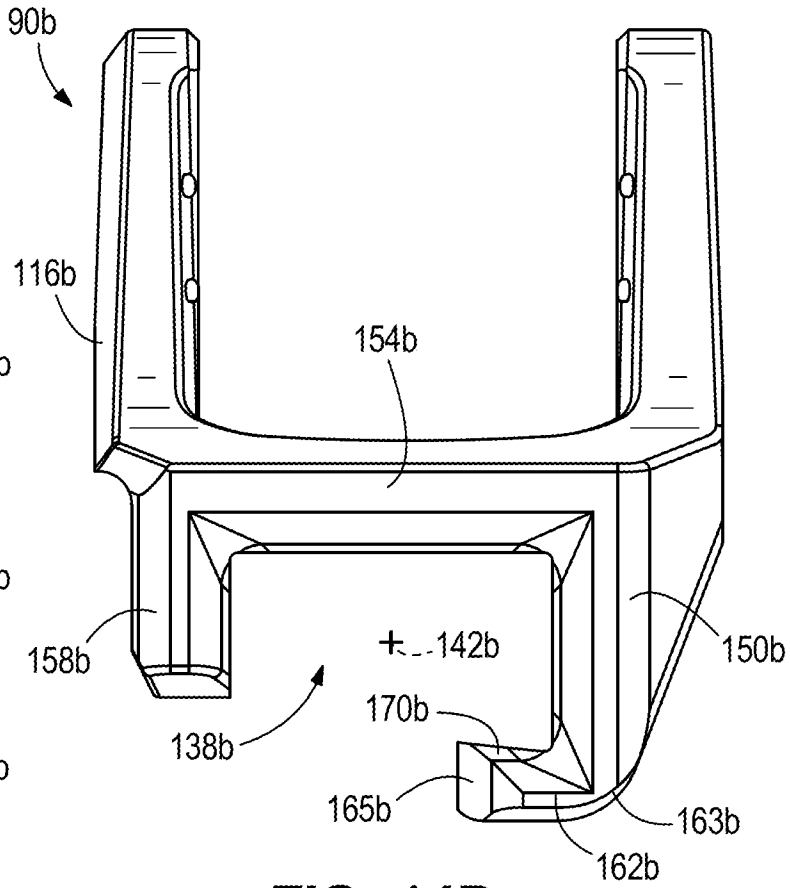
FIG. 14B is an end view of the guide shoe of FIG. 14A.
Figure 14A:
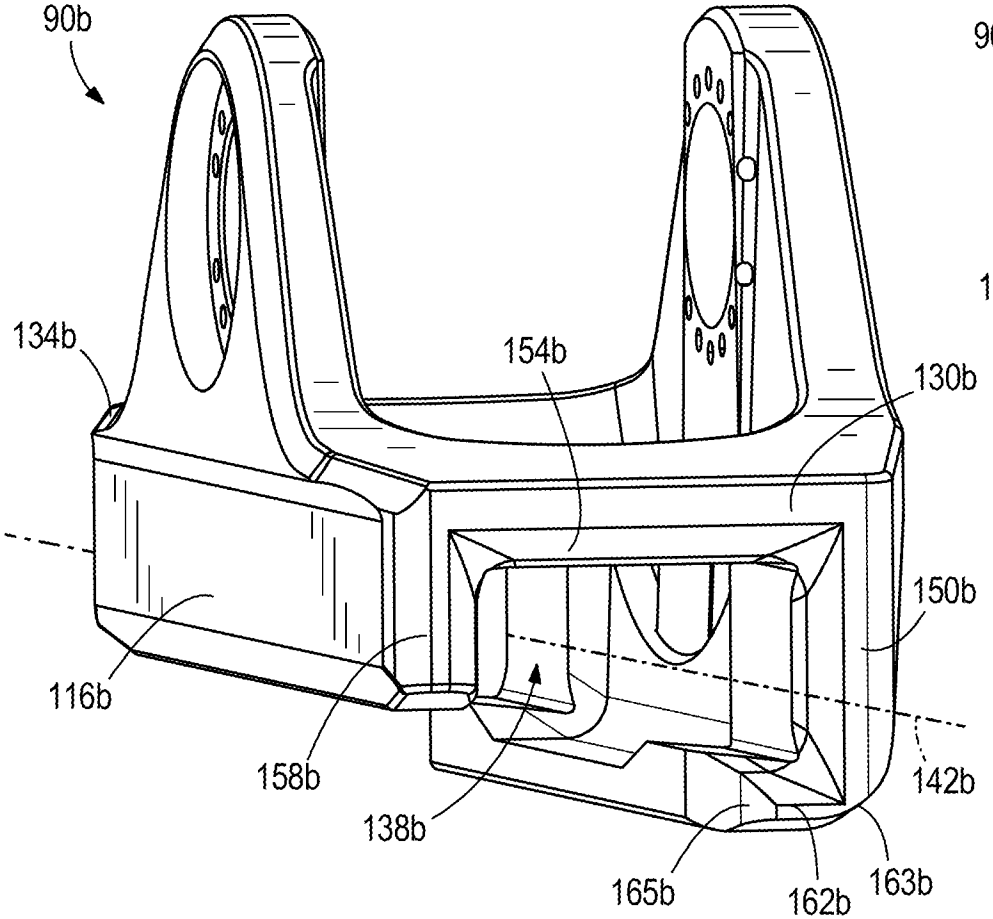
FIG. 14A is a perspective view if the guide shoe of FIG. 13A.

Referring to FIGS. 13A-14B, the guide shoe 90*b* includes a shoe body 116*b* having a first end 130*b* and a second end 134*b*. A slot 138*b* extends longitudinally between the first end 130*b* and the second end 134*b* along a slot axis 142*b*. The shoe body 116*b* includes a first wall or base wall 150*b*, a second wall or upper wall 154*b*, a third wall or lateral guide wall 158*b*, and a fourth wall or hook 162*b*. The lateral guide wall 158*b* protrudes from the upper wall in a direction parallel to the base wall 150*b*. The lateral guide wall 158*b* is spaced apart from the base wall 150*b* and extends parallel to the slot axis 142*b*. The hook 162*b* protrudes from the base wall 150*b*. The slot 138*b* is generally formed between the base wall 150*b*, the upper wall 154*b*, the lateral guide wall 158*b*, and the hook 162*b*. With reference to FIGS. 13B and 14B, the hook 162*b* protrudes from the base wall 150*b* in a direction orthogonal to the upper wall 154*b*. A surface 170*b* of the hook 162*b* is substantially planar and is inclined. Stated another way, the surface 170*b* of the hook 162*b* is oriented at an oblique angle (e.g., non-parallel) relative to the upper wall 154*b*. The hook surface 170*b* is slanted toward the upper wall 154 (e.g., downwardly) from a distal end 165*b* of the hook 162*b* toward an end 163*b* adjacent the base wall 150*b*.

During operation, the hook 162*b* is positioned adjacent a lower surface of the rack 82*b* (FIG. 3), and the lateral guide wall 158*b* is positioned adjacent a side surface of the rack 82*b* (e.g., a rearward facing surface of the rack 82*b*). The hook 162*b* maintains positive engagement between the sprocket 78 and the rack 82*b* while the shoe 90*b* slides relative to the rack 82*b*.

As shown in FIGS. 13A and 13B, when the rack 82*b* is positioned within the slot 138*b* of the shoe 90*b*, the base edge 106*b* of the second rail 102*b* of the rack 82*b* engages the surface 170*b* of the hook 162*b*. That is, the profiled surface (e.g., the edge 106*b*) of the rack 82*b* engages with the profiled surface (e.g., the surface 170*b*) of the hook 162*b*. The inclined edge 106*b* of the rail and the surface 170*b* of the hook 162*b* facilitates engagement between the rack 82*b* and the hook 162*b*, thereby minimizing misalignment that may occur due to wear.

FIGS. 16A-18B illustrate a guide shoe 90*c* and rack 82*c* according to another embodiment. Specifically, FIGS. 16A-18B illustrate a profiled, rounded surface on the rack 82*c* and a surface having a complementary profile on the hook 162*c* of the guide shoe 90*c*. For the sake of brevity, some of the differences between the guide shoe 90*c* and guide shoe 90, and the rack 82*c* and the rack 82 are described. Similar features are labeled with similar reference numbers, plus the suffix 'c'.

Figure 16A:
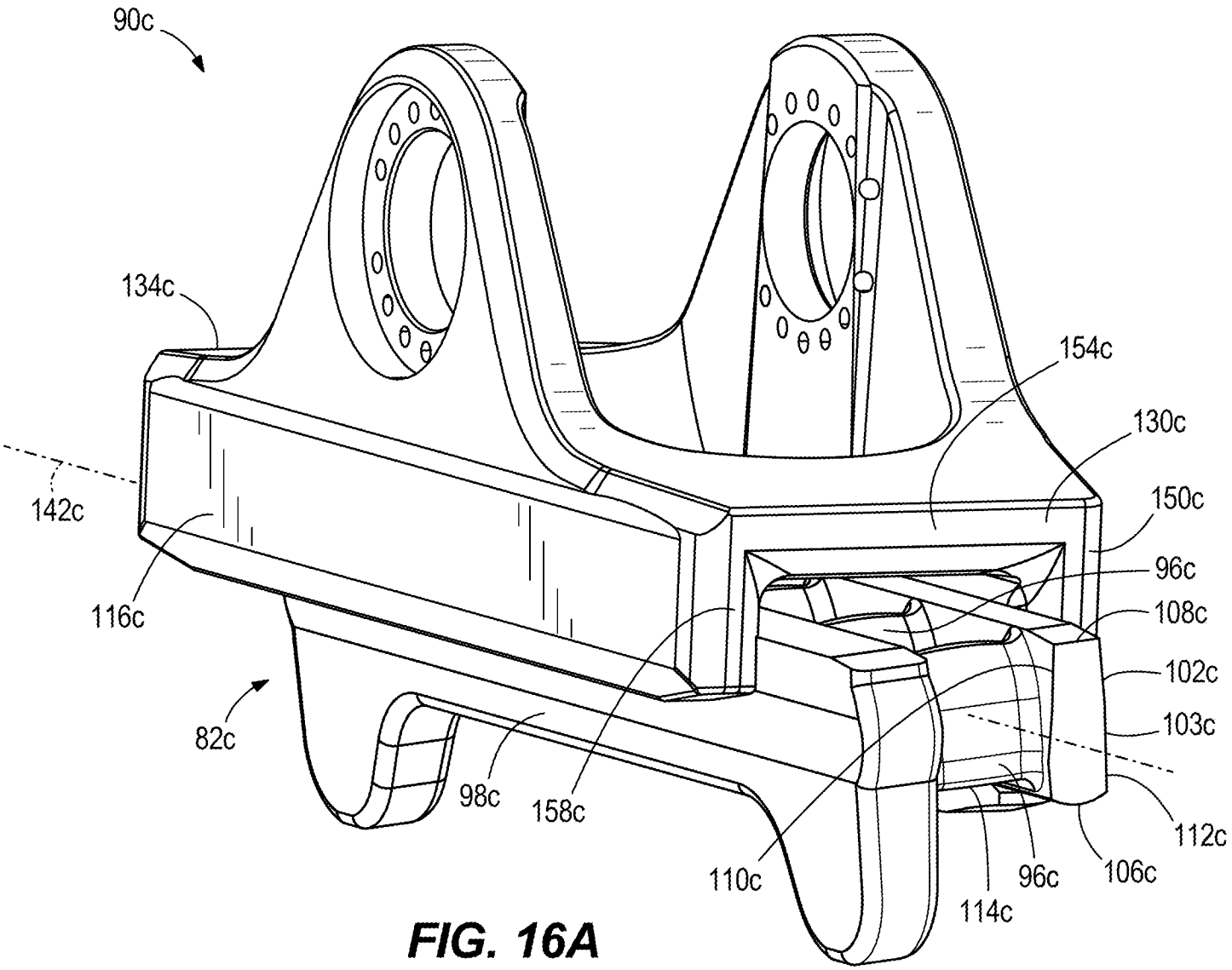
FIG. 16A is a perspective view of a guide shoe and a rack, according to another embodiment.
Figure 16B:
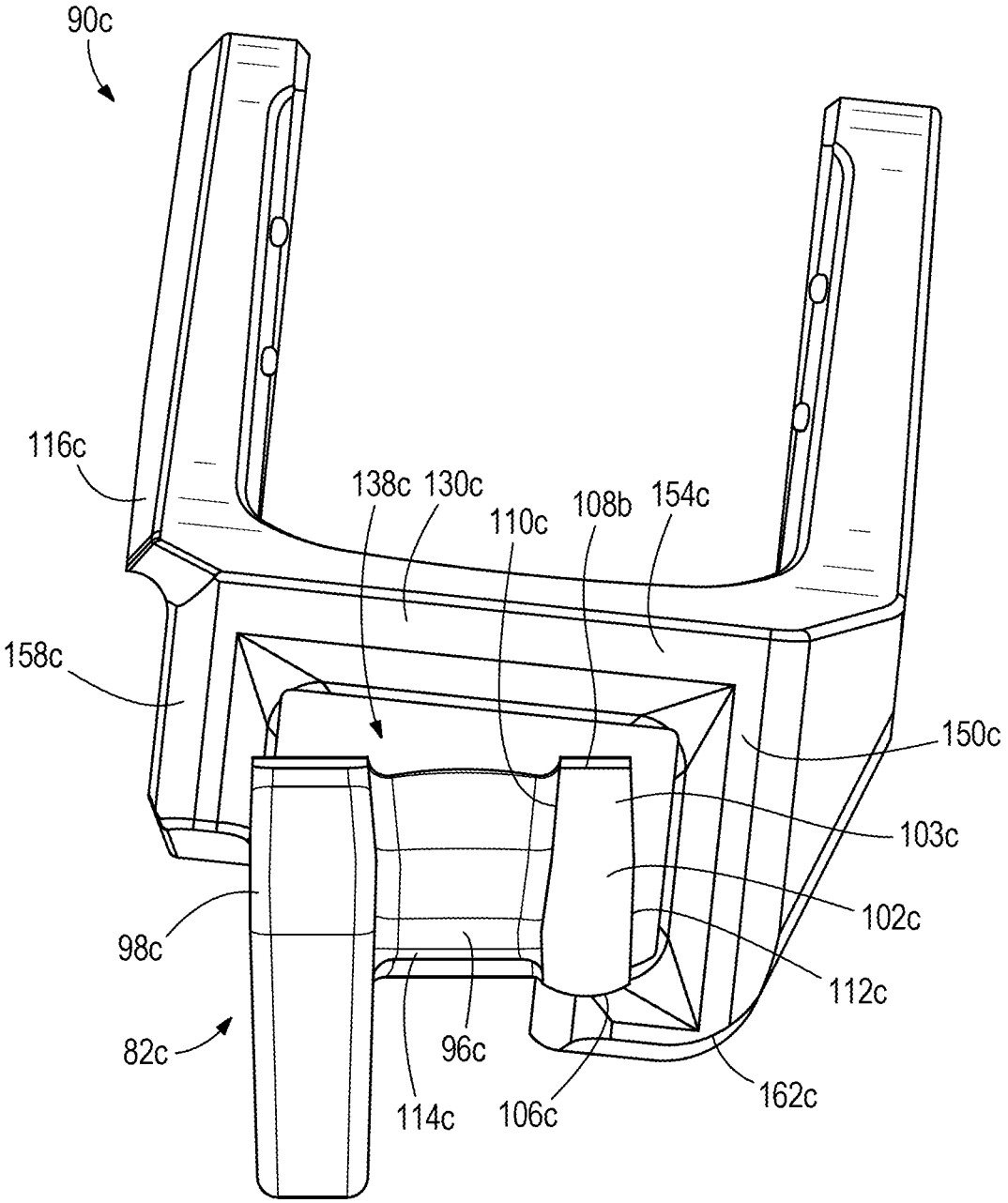
FIG. 16B is an end view of the guide shoe and rack of FIG. 16A.
Figure 18A:
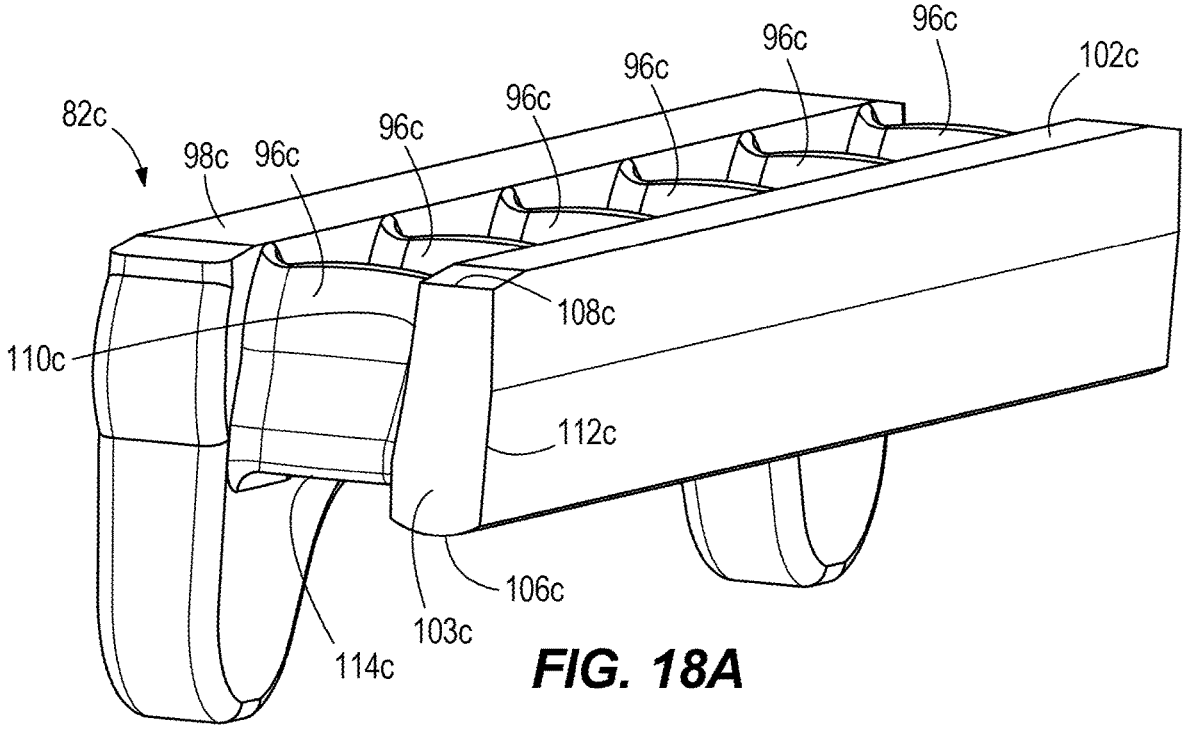
FIG. 18A is a perspective view of the rack of FIG. 16A.
Figure 18B:
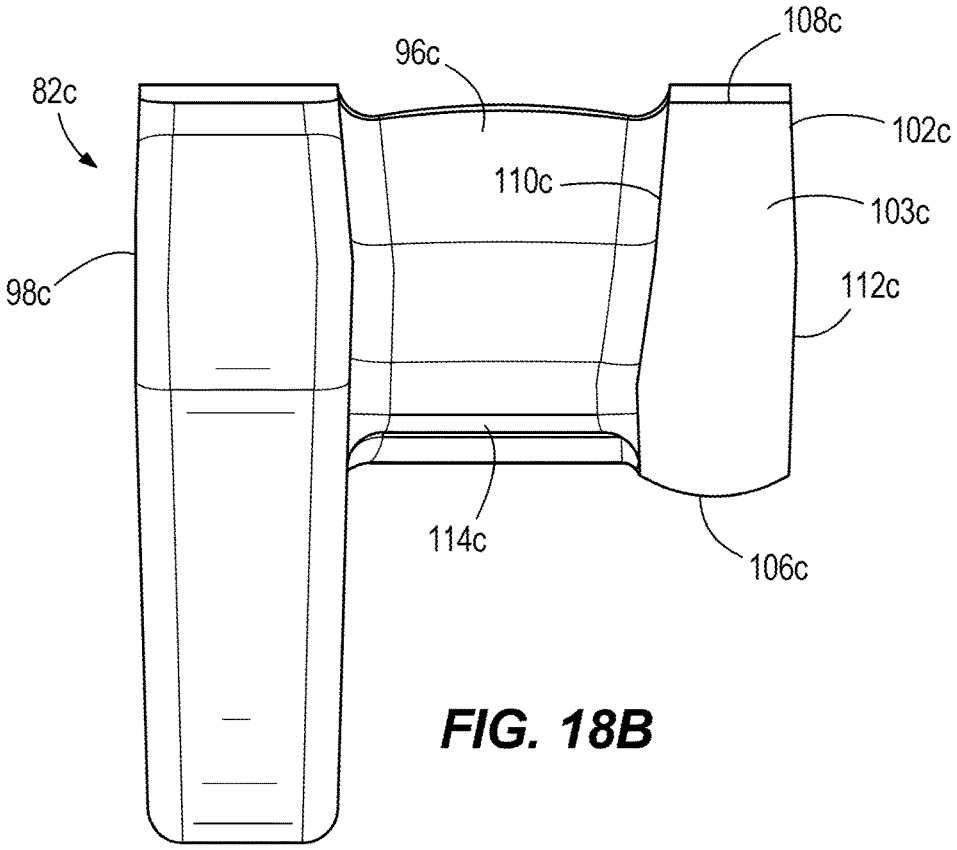
FIG. 18B is an end view of the rack of FIG. 18A.

Referring to FIGS. 16A-16B and 18A-18B, the rack 82*c* includes a first rail 98*c*, a second rail 102*c*, and rack teeth 96*c*, similar to the rack 82*c* described above. A distal end 103*c* of the second rail 102*c* includes a first edge or base edge 106*c*, a second edge or upper edge 108*c*, a third edge or inner edge 110*c*, and a fourth edge or outer edge 112*c*. An edge 114*c* of one of the teeth 96*c* positioned adjacent the distal end 103*c* of the second rail 102*c* extends between the third edge 110*c* and the first rail 98*c*. As best shown in FIGS. 16B and 18B, the first edge 106*c* has an arcuate or curved profile. In the illustrated embodiment, the first edge 106*c* has a profile that is convex relative to the second edge 108*c*.

Figures 17A, 17B:
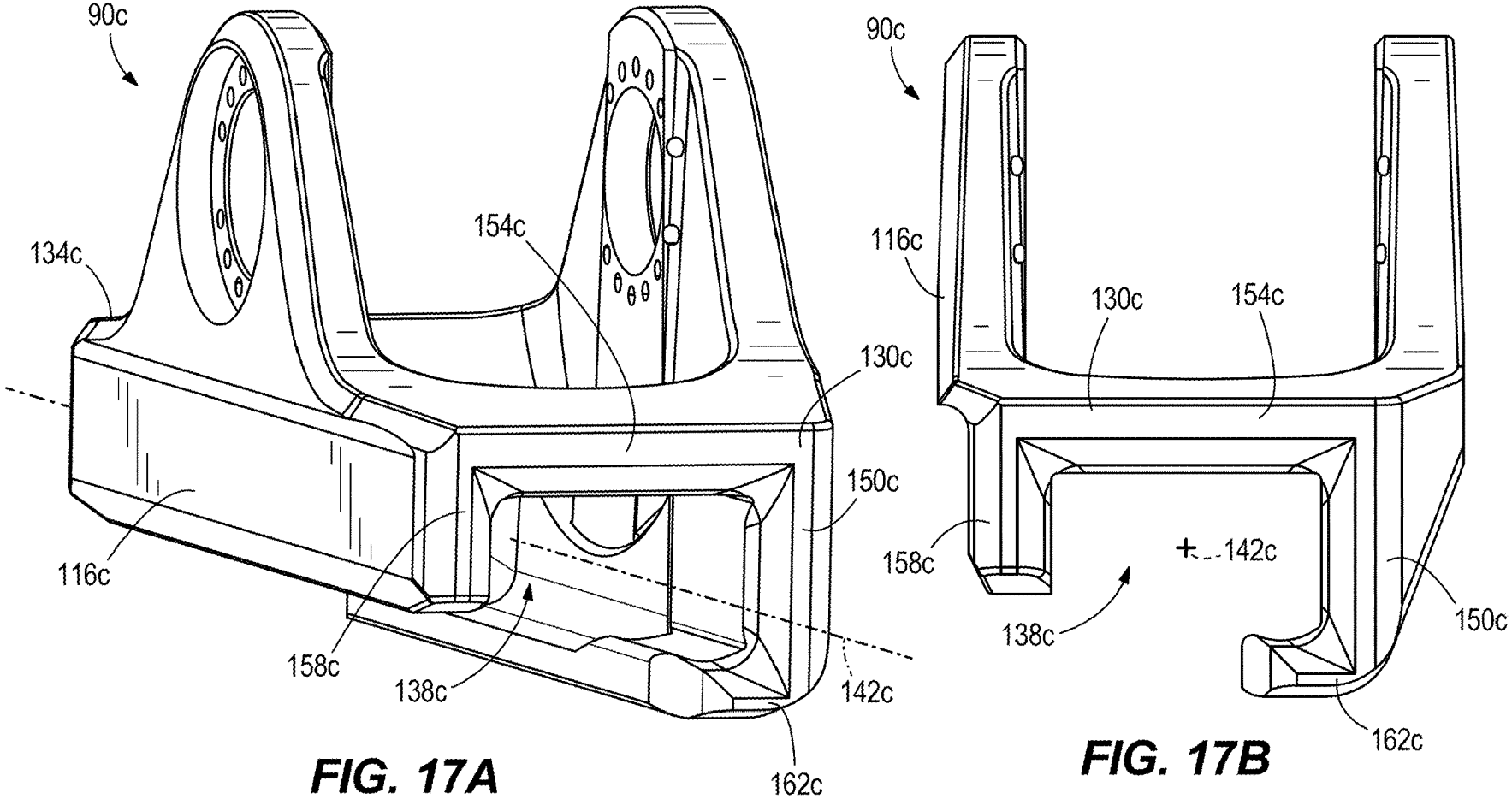
FIG. 17A is a perspective view of the guide shoe of FIG. 16A.
FIG. 17B is an end view of the guide shoe of FIG. 17A.

Referring to FIGS. 16A-17B, the guide shoe 90*c* includes a shoe body 116*c* having a first end 130*c* and a second end 134*c*. A slot 138*c* extends longitudinally between the first end 130*c* and the second end 134*c* along a slot axis 142*c*. The shoe body 116*c* includes a first wall or base wall 150*c*, a second wall or upper wall 154*c*, a third wall or lateral guide wall 158*c*, and a fourth wall or hook 162*c*. The lateral guide wall 158*c* protrudes from the upper wall 154*c* in a direction parallel to the base wall 150*c*. The lateral guide wall 158*c* is spaced apart from the base wall 150*c* and extends parallel to the slot axis 142*c*. The hook 162*c* protrudes from the base wall 150*c*. The slot 138*c* is generally formed between the base wall 150*c*, the upper wall 154*c*, the lateral guide wall 158*c*, and the hook 162*c*. With reference to FIGS. 16B and 17B, the hook 162*c* protrudes from the base wall 150*c* in a direction orthogonal to the upper wall 154*c*. A surface 170*c* of the hook 162*c* has an arcuate or curved profile that is substantially complementary to the profile of the first edge 106*c*. In the illustrated embodiment, the edge 170*c* of the hook 162*c* has a profile that is concave relative to the second wall 154*c*.

During operation, the hook 162*c* is positioned adjacent a lower surface of the rack 82*c* (FIG. 3), and the lateral guide wall 158*c* is positioned adjacent a side surface of the rack 82*c* (e.g., a rearward facing surface of the rack 82*c*). The hook 162*c* maintains positive engagement between the sprocket 78 and the rack 82*c* while the shoe 90*c* slides relative to the rack 82*c*.

As shown in FIGS. 16A and 16B, when the rack 82*c* is positioned within the slot 138*c* of the shoe 90*c*, the base edge 106*c* of the second rail 102*c* of the rack 82*c* engages the edge 170*c* of the hook 162*c*. That is, the profiled surface (e.g., the curved edge 106*c*) of the rack 82*c* engages with the profiled surface (e.g., the curved edge 170*c*) of the hook 162*c*. The curved edge 106*c* of the rack 82*c* and the surface 170*c* of the hook 162*c* facilitates engagement between the rack 82*c* and the hook 162*c*, thereby minimizing misalignment that may occur due to wear.

Although some aspects of certain embodiments have been described in detail, variations and modifications exist within the scope and spirit of one or more independent aspects as described.

What is claimed is:

1. A drive mechanism for a mining machine, the drive mechanism configured to engage and move the mining machine along a rack, the drive mechanism comprising:

a gear configured to engage the rack, rotation of the gear causing movement of the mining machine along the rack; and a guide shoe for maintaining engagement between the gear and the rack, the guide shoe including a first wall, a second wall extending orthogonally from a first end of the first wall, a third wall extending orthogonally from a distal end of the second wall, and a fourth wall extending orthogonally from a second end of the first wall, the fourth wall having a planar surface oriented at an oblique angle relative to the second wall, wherein the planar surface is configured to engage a surface of the rack.

2. The drive mechanism of claim 1, wherein the surface of the rack is planar and oriented at an oblique angle relative to the second wall of the guide shoe.

3. The drive mechanism of claim 2, wherein the surface of the fourth wall and the surface of the rack are angled in the same direction.

4. The drive mechanism of claim 1, wherein the surface of the fourth wall and the surface of the rack have complementary curved profiles.

5. The drive mechanism of claim 4, wherein one of the surface of the fourth wall and the surface of the rack has a concave profile.

6. The drive mechanism of claim 1, wherein the surface of the fourth wall is oriented at an angle relative to the surface of the rack, and wherein the surface of the rack is planar and oriented parallel to an upper surface of the rack.

7. The drive mechanism of claim 1, wherein the surface of the rack is oriented at an angle relative to the second wall of the guide shoe.

8. The drive mechanism of claim 1, wherein the fourth wall provides a hook and the planar surface is positioned on the hook.

9. The drive mechanism of claim 1, wherein the rack includes a first rail, a second rail oriented parallel to the first rail, and a plurality of teeth positioned between the first rail and the second rail.

10. The drive mechanism of claim 1, wherein the planar surface is oriented at an oblique angle, a distance between a first end of the planar surface and the second wall being less than a distance between a distal end of the planar surface and the second wall.

11. The drive mechanism of claim 1, wherein the planar surface is oriented at an oblique angle, a distance between a first end of the planar surface and the second wall being greater than a distance between a distal end of the planar surface and the second wall.

12. A drive mechanism for a mining machine, the drive mechanism configured to engage and move the mining machine along a rack, the drive mechanism comprising:

a gear configured to engage the rack such that rotation of the gear moves the mining machine along the rack; and a guide shoe for maintaining engagement between the gear and the rack, the guide shoe including a wall providing a hook, wherein the rack includes a rail adjacent to the guide shoe and having a planar surface configured to engage the hook, the rail including a first edge and a second edge, the planar surface positioned on the first edge, the planar surface being oriented at an oblique angle relative to the second edge, a distance between a first end of the first edge and the second edge being less than a distance between a second end of the first edge and the second edge.

13. The drive mechanism of claim 12, wherein the wall is a first wall, the guide shoe further including a second wall extending from a first end of the first wall, a third wall extending from a distal end of the second wall, and a fourth wall extending from a second end of the first wall, wherein the fourth wall includes the hook.

14. The drive mechanism of claim 13, wherein the hook includes a surface oriented at an oblique angle relative to the first wall.

15. The drive mechanism of claim 13, wherein the first wall is oriented perpendicular to the second wall and parallel to the third wall.

16. The drive mechanism of claim 13, wherein the hook is oriented at an oblique angle, a distance between a first end of the hook and the second wall being less than a distance between a distal end of the hook and the second wall.

17. The drive mechanism of claim 13, wherein the hook is oriented at an oblique angle, a distance between a first end of the hook and the second wall being greater than a distance between a distal end of the hook and the second wall.

18. An interface between a guide shoe of a mining machine and a rack, the interface comprising:

a first surface positioned on the guide shoe, the guide shoe including a first wall, a second wall extending orthogonally from a first end of the first wall, a third wall extending orthogonally from a distal end of the second wall, and a fourth wall extending orthogonally from a second end of the first wall, the fourth wall including the first surface; and a second surface positioned on the rack, the rack including a rail and a plurality of teeth, the second surface positioned on the rail, wherein the first surface has a concave profile and the second surface has a convex profile that is complementary to the concave profile.

19. The interface of claim 18, wherein the first surface is oriented at an oblique angle relative to a plane of the rack.

20. The interface of claim 18, wherein the second surface is oriented at an oblique angle relative to a plane of the rack.

21. The interface of claim 18, wherein the first surface is oriented at an oblique angle relative to a plane of the rack, and the second surface oriented at an oblique angle relative to the plane of the rack.

* * * * *